US008085242B2

(12) United States Patent
Endoh et al.

(10) Patent No.: US 8,085,242 B2
(45) Date of Patent: Dec. 27, 2011

(54) INPUT CONTROL DEVICE AND IMAGE FORMING APPARATUS

(75) Inventors: Tsuyoshi Endoh, Kanagawa (JP); Kazuo Koike, Kanagawa (JP); Kenichi Yamada, Kanagawa (JP); Tasuku Kohara, Kanagawa (JP); Taisuke Omi, Kanagawa (JP); Takashi Inoue, Saitama (JP); Hiroki Tsuruoka, Kanagawa (JP); Yoshiaki Nishizaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 719 days.

(21) Appl. No.: 12/219,765

(22) Filed: Jul. 28, 2008

(65) Prior Publication Data

US 2009/0066644 A1 Mar. 12, 2009

(30) Foreign Application Priority Data

Sep. 10, 2007 (JP) ..... 2007-233835
Nov. 6, 2007 (JP) ..... 2007-288525

(51) Int. Cl.
*G09G 5/08* (2006.01)

(52) U.S. Cl. ..... 345/157; 345/156

(58) Field of Classification Search ..... 345/156–161, 345/173–178, 204–215; 178/18.01–18.06
See application file for complete search history.

(56) References Cited

U.S. PATENT DOCUMENTS

| | | | | |
|---|---|---|---|---|
| 5,390,005 | A | 2/1995 | Kimoto et al. | |
| 5,987,227 | A | 11/1999 | Endo et al. | |
| 6,226,102 | B1 | 5/2001 | Koike et al. | |
| 6,392,638 | B2 * | 5/2002 | Hanajima et al. | 345/173 |
| 2002/0008691 | A1 | 1/2002 | Hanajima et al. | |
| 2003/0001825 | A1 | 1/2003 | Omura et al. | |
| 2005/0270276 | A1 * | 12/2005 | Sugimoto et al. | 345/173 |
| 2007/0059032 | A1 | 3/2007 | Yamada et al. | |
| 2008/0089017 | A1 | 4/2008 | Yamada et al. | |

FOREIGN PATENT DOCUMENTS

| | | |
|---|---|---|
| EP | 476 972 A2 | 3/1992 |
| EP | 1 603 025 A2 | 12/2005 |
| JP | 11-65769 | 3/1999 |
| JP | 2006-227171 | 8/2006 |
| WO | WO00/68930 | 11/2000 |

* cited by examiner

*Primary Examiner* — Vijay Shankar
(74) *Attorney, Agent, or Firm* — Dickstein Shapiro LLP

(57) ABSTRACT

An input control device and an image forming apparatus capable of providing an easy-to-use operating environment even for a user having difficulties operating such conventional devices and apparatuses due to his/her height, color vision deficiency, weak vision, use of a wheelchair, and the like is disclosed. In the input control device, based on the detected distance between an instruction item on the display and an operation direction element (such as a user's finger), the display mode of the instruction item is changed (by, for example, changing positions, colors, and combinations). Further, as the operation direction element approaches, the size of the instruction item on the display becomes larger, thereby improving the operability especially for a user with color vision deficiency or weak vision.

12 Claims, 16 Drawing Sheets

THIRD DISPLAY
24
14
READY TO COPY
111 222 333
AUTO A3 B4 A4 A5 B4 BY-PASS
100%

24
14
READY TO COPY
111 222 333
AUTO A3 B4 A4 B5 A5 BY-PASS
100%

22
FIRST DISPLAY
23
SECOND DISPLAY
24
14
READY TO COPY
111 222 333
AUTO A3 B4 A4 B5 A5 BY-PASS
100%

23

PAPER SHEET
21 SELECTION KEYS
14
OPERATION
INSTRUCTION
MEANS
15

READY TO COPY
AUTO
A3
B4
A4
B5
A5
BY-PASS
100%
22
24
23
21a

A3
22a
24a
23a
15
21b

A3
22b
24b
23b

PAPER SHEET
21 SELECTION KEYS
15
23
24
14
22
READY TO COPY
111
222
333
AUTO
A3
B4
A4
B5
A5
BY-PASS
100%

21'a 23e
24e
22e

INPUT CONTROL DEVICE AND IMAGE FORMING APPARATUS

CROSS-REFERENCE TO RELATED APPLICATIONS

The present application claims priority under 35 U.S.C §119 to Japanese Patent Application Publication Nos. 2007-233835 filed Sep. 10, 2007 and 2007-288525 filed Nov. 6, 2007, the entire contents of which are hereby incorporated herein by reference.

BACKGROUND OF THE INVENTION

1. Field of the Invention

The present invention generally relates to a control device of an input unit such as an operations panel of an image forming apparatus and the like, and more specifically to an input control device having an operations panel capable of being detached as a remote controller and changing a display mode of the display of the input control unit in accordance with a detected position of operation instruction means such as a user's finger, and an image forming apparatus having such an input control device.

2. Description of the Related Art

Recently, more and more public buildings, offices, homes, and the like have been made barrier-free. Further, it has been desired to make not only buildings but also home appliances, information apparatuses and the like used in such buildings barrier-free. Furthermore, as social structure changes where, for example, more and more people with disabilities are playing increasingly important roles outside the home, providing an more easier-to-use user interface in apparatuses in the public institutions, offices, and the like has become required to assist especially those people.

However, unfortunately, in most OA (Office automation) apparatuses currently available such as image forming apparatuses including copiers, printers, facsimile machines, and multifunction peripherals, the height of the operations section of such apparatuses has been determined based on the average height of the users. Further, the height of the operations section is usually fixed and cannot be adjusted. As a result, for such users having a height considerably different from the average height and users using wheelchairs, the operability may be largely impaired.

To solve the problems, Patent Document 1 discloses an image forming apparatus having an elevation mechanism capable of lifting up and down the main body of the apparatus to adjust the height of the whole image forming apparatus. Further, Patent Document 2 discloses an apparatus where only the height of the operations panel is adjustable, and Patent Document 3 discloses an apparatus where the heights of the operations panel and the discharge tray are adjustable.

In those apparatuses according to Patent Documents 1 through 3, the height of the operations panel is adjustable. However, in a process of using an image forming apparatus, it is desired to improve the operability of not only the operations panel but also the draft table where a draft is placed in the draft reading section of the apparatus. To this end, Patent Document 4 discloses an apparatus where its image reading section can be separated from the main body of the image forming apparatus, and a height adjustment mechanism is provided. Further, Patent Document 5 discloses an apparatus having a mechanism capable of adjusting the height of the image reading section and the operations panel as well.

In addition to the above apparatuses, to make the operations panel easier-to-use, some apparatuses have a tilting mechanism to adjust the installation angle of the operations panel.

Further, Patent Document 6 discloses an operations panel for an electronic apparatus including an image forming apparatus, where the operations panel is capable of being separated from the main body of the apparatus and used. This feature improves the operability of the operations section of the apparatus for users who otherwise would have difficulties in operations due to his/her height and use of a wheelchair. Further, because users can operate the operations panel while holding it in his/her hands, a user having difficulty in reading characters and the like on the operations panel due to a color vision deficiency or weak-sightedness may operate the operations panel more easily.

Patent Document 1: Japanese Patent Application Publication No. 2000-214731

Patent Document 2: Japanese Patent Application Publication No. H06-003881

Patent Document 3: Japanese Patent Application Publication No. 2005-010394

Patent Document 4: Japanese Patent Application Publication No. 2005-099567

Patent Document 5: Japanese Patent Application Publication No. 2005-300872

Patent Document 6: Japanese Patent Application Publication No. 2006-227171

Patent Document 7: Japanese Patent Application Publication No. H11-065769

As described above, in apparatuses according to Patent Documents 1 through 5, the improvement of the operability of an image forming apparatus and the like is achieved for users using wheelchairs by providing techniques described above. Similarly, in an apparatus according to Patent Document 6, the improvement of the operability of an image forming apparatus and the like is achieved for users with color vision deficiency or weak sightedness by making the operations panel detachable. In this apparatus according to Patent Document 6, since the operations panel is detachable, a user can bring the operations panel near his/her face to operate it. In this case, it may become easier for users to recognize what is displayed on the operations panel. However, there may arise a problem that it may still be difficult for some users to operate the operations panel (for example, pressing the button on the operations panel) when the operations panel is positioned near the user's face.

SUMMARY OF THE INVENTION

The present invention is made in light of the above problems, and may provide an input control device capable of not only the operations panel being separated from the main body but also changing a display mode of the display on the operations panel in accordance with the detected position of operation instruction means such as the user's finger with respect to the separated operations panel. This configuration allows a user to separate the operations panel and operate the operations panel providing an easy-to-use operating environment. This easy-to-use operating environment is useful and helpful especially for users with disabilities including color vision deficiency and weak sightedness, users using a wheelchair, and users having difficulty operating a conventional apparatus due to his/her height.

According to a first aspect of the present invention, there is provided an input control device for an electronic apparatus. The input control device includes plural selection operation units each inputting the information of an instruction item selected from prescribed instruction items related to the corresponding operations of the electronic apparatus; a selected information output unit outputting the information of the instruction item input through each of the selection operation units to the electronic apparatus; and a display operation unit which is one of the selection operation units. The display operation unit includes a display unit for displaying the instruction items, an input unit for inputting the information of the instruction item selected from among the instruction items displayed on the display unit, an instruction position detection unit for detecting the position of operation instruction means for selecting the instruction item displayed on the display operation unit, and a display control unit for changing a display mode of the display unit in accordance with the distance between the operation instruction means and the instruction item that is detected by the instruction position detection unit and that is displayed on the display unit. Because of this configuration, the display mode of the display unit can be changed (by, for example, enlarging the instruction item) in accordance with the detection results of which of the selection operation units is separated from the input control device and the position of the operation instruction means, thereby enabling the improvement of the operability of the input control device due to the capability of corresponding to various using situations and plural users.

According to a second aspect of the present invention, there is provided the input control device according to the first aspect, in which, when any of the selection operation units each removably mounted on the input control device is separated from the input control device, the display control unit changes the display mode of the instruction items of the selection operation units in accordance with the situation of which of the selection operation units is separated from the input control device. Because of this arrangement, the instruction items of the selection operation unit separated from the input control device are displayed, thereby enabling input control corresponding to the using situations and the improvement of the operability.

According to a third aspect of the present invention, there is provided the input control device according to the second aspect, in which the display control unit divides the display of the display unit in accordance with the situation of which of the selection operation units is separated, and when the display control unit changes the display mode of the area for one of the selection operation units, the display control unit does not change the display mode of the areas of the other selection operation units. Because of this arrangement, by maintaining the display mode of the areas of the other selection operation units, it may becomes possible for a user to recognize the instruction item necessary for the next operation step, thereby improving the operability.

According to a fourth aspect of the present invention, there is provided the input control device according to any one of the first through third aspects, in which the display control unit is capable of selecting the display modes including the determination whether the display control unit changes the display mode in accordance with the situation of which of the selection operation units is separated from the input control device. Because of this arrangement, it becomes possible to switch the display mode in accordance with the tastes of the users and improve the operability even when plural users use the same apparatus.

According to a fifth aspect of the present invention, there is provided the input control device according to any one of the first through the fourth aspects. The input control device further includes a block specifying unit for specifying an item block having plural instruction items including the instruction item closest to the operation instruction means. In this configuration, when the position of the operation instruction means detected by the instruction position detection unit is within a prescribed distance, the display control unit changes the display mode of the item block specified by the block specifying unit. Because of this configuration, it becomes possible to avoid complex operations because plural instruction items are divided into a smaller number of item blocks.

According to a sixth aspect of the present invention, there is provided the input control device according to the fifth aspect, in which the block specifying unit specifies the item block including the instruction item including the shortest distance to the operation instruction means and the other instruction items having the similar functions to that of the instruction item having the shortest distance to the operation instruction means. Because of this arrangement, it may become possible to recognize plural instruction items having a similar function because those instruction items are displayed without being cut out when the enlargement is performed on the display, thereby enabling easy selections and improving the operability of the apparatus.

According to seventh through ninth aspects of the present invention, there are provided the input control devices according to the fifth or sixth aspect, in which after the position of the operation instruction means detected by the instruction position detection unit reaches within a prescribed distance, the display control unit changes the display mode of the item block item block in accordance with the distance detected by the instruction position detection unit, the item block including the instruction item having the shortest distance to the operation instruction means and the other instruction items having similar functions to that of the instruction item having the shortest distance to the operation instruction means; in which, when the position of the operation instruction means detected by the instruction position detection unit reaches within a prescribed distance and the position is not above the display operation unit, the display control unit changes the display mode of the item block including the instruction item having the shortest distance to the operation instruction means and the other instruction items having similar functions to that of the instruction item having the shortest distance to the operation instruction means; and in which after the position of the operation instruction means detected by the instruction position detection unit reaches within a prescribed distance and when the position of the operation instruction means detected by the instruction position detection unit reaches within another prescribed distance, the display control unit changes the display mode of the instruction item having the shortest distance to the operation instruction means included in the item block specified by the block specifying unit. Because of these arrangements, it may become easy to recognize the instruction item from among plural instructions items, thereby facilitating the selections and improving the operability of the apparatus.

According to tenth and eleventh aspects of the present invention, there are provided the input control devices according to any one of the fifth through ninth aspects, in which the method of changing the display mode of the item block and the selected instruction item under the control of the display control unit to distinguish the item block and the instruction item from the other instruction items includes changing colors, changing brightness, using highlighted portions, and using blinking portions, and in which the method of changing the display mode of the item block and the selected instruction item under the control of the display control to distinguish the item block and the instruction item from the other instruction items is enlarging an image. Because of those arrangements, it may become easy to select from plural instruction items, thereby facilitating the input operations.

According to a twelfth aspect of the present invention, there is provided an image forming apparatus including an input control device according to any one of the first through eleventh aspects, and a process of forming an image is performed in accordance with the information of the instruction item output from the input control device. Because of this configuration, it becomes possible to provide an image forming apparatus capable of changing the display mode (such as enlarging the instruction item), thereby enabling the improvement of the operability due to the capability of corresponding to various using situations and plural users.

According to an embodiment of the present invention, due to the capability of separating a selection operation unit from the main body of the apparatus and changing the display mode (for example, sizes, arrangement, colors) of the display menu on the operation section based on the detection of the position of the operation instruction means such as a user's finger, it becomes possible to improve the operability due to the capability of corresponding to various using situations and plural users. Further, especially, it becomes possible even for a user having physical characteristics, such as his/her height, use of a wheelchair, having color vision deficiency or weak sightedness, which make it difficult to operate a conventional apparatus may easily operate the apparatus.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In the following, embodiments of the present invention are described with reference to the accompanying drawings.

Figure 1:
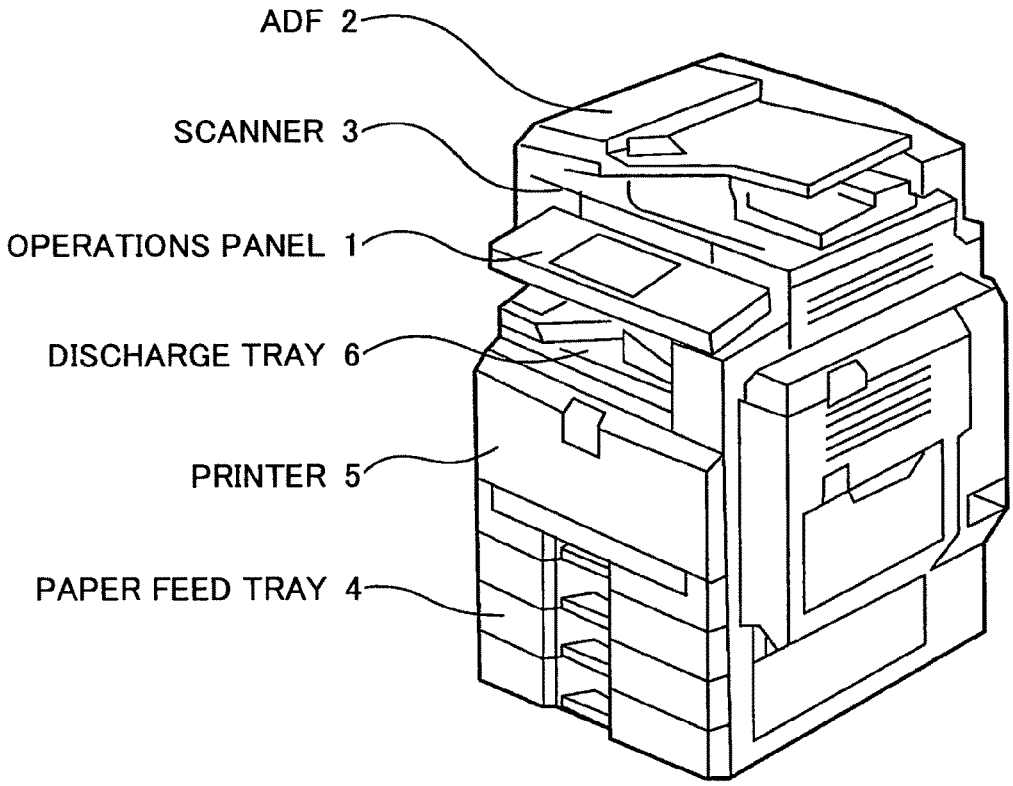
FIG. 1 is a perspective view showing an image forming apparatus according to an embodiment of the present invention.

FIG. 1 is a perspective view showing an exemplary image forming apparatus (a copier in this example) according to an embodiment of the present invention. As shown in FIG. 1, the image forming apparatus includes an apparatus main body, an operations panel 1 having plural selective operation sections and capable of communicating with the apparatus main body, an ADF 2 for feeding a draft sheet to a scanner section, a scanner 3 reading an image on the draft sheet to be copied, a paper feed tray 4, a printer 5 (not shown due to the built-in structure) for outputting the read image onto a paper sheet from the paper feed tray 4, and a discharge tray 6.

Figure 2A:
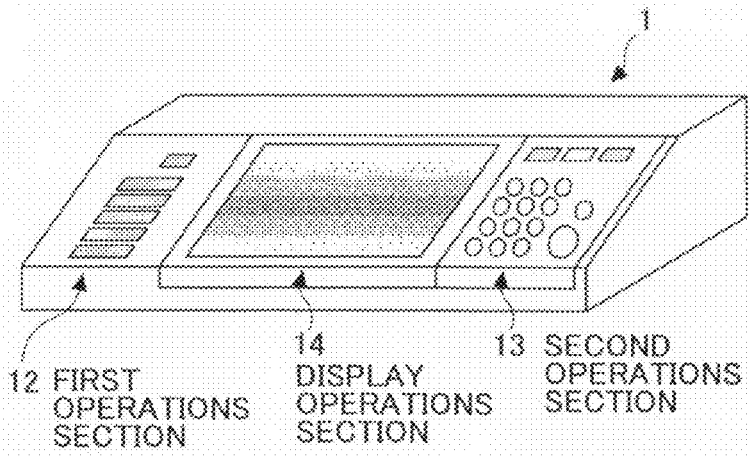
FIG. 2A is a view showing where a display operations section and a second operations section are mounted on an operations section base.
Figure 2B:
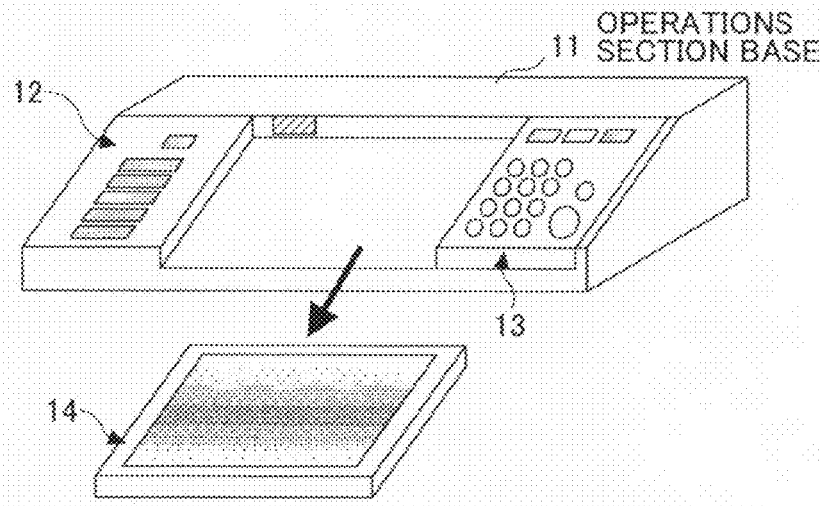
FIG. 2B is a view showing where the display operations section is separated from and the second operations section is mounted on the operations section base.
Figure 2C:
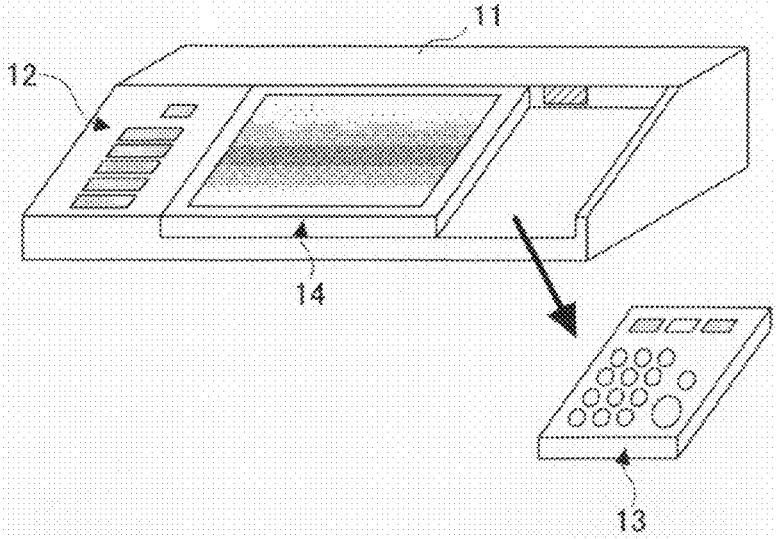
FIG. 2C is a view showing where the display operations section is mounted on and the second operations section is separated from the operations section base.

FIGS. 2A through 2C show the operations panel 1 including an operations section base 11, a first operations section 12, a second operations section 13, and a display operations section 14. The first operations section 12 has application keys for selecting functions of the image forming apparatus. The second operations section 13 is removably mounted on the operations section base 11 and includes ten keys, a start key, a stop key, and the like. The display operations section 14 is also removably mounted on the operations section base 11 and includes a display section of such as an LCD and an input section such as a touch panel. FIG. 2A shows where both the display operations section 14 and the second operations section 13 are mounted on the operations section base 11. FIG. 2B shows where only the display operations section 14 is separated from the operations section base 11. FIG. 2C shows where only the second operations section 13 is separated from the operations section base 11.

Figure 3:
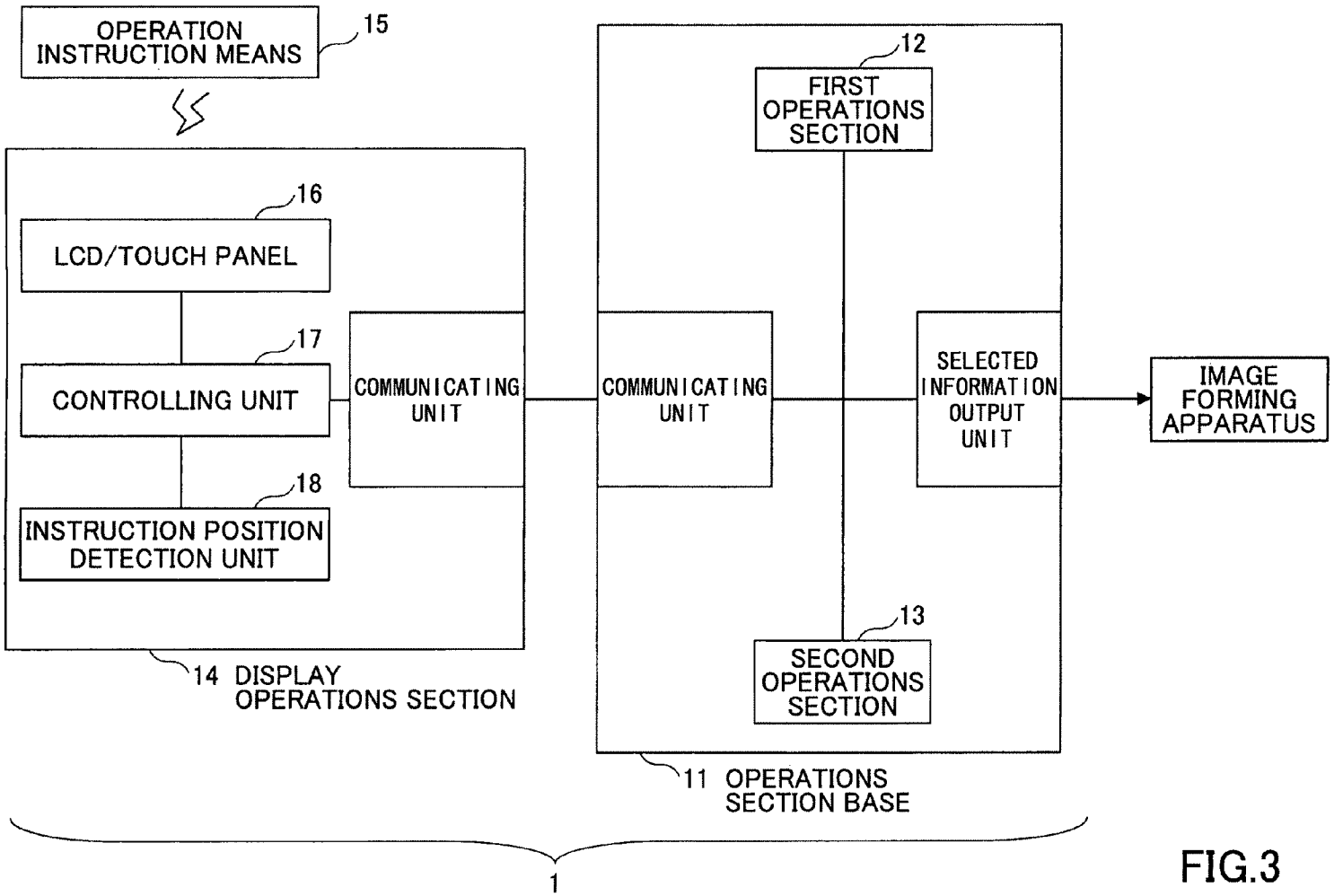
FIG. 3 is a schematic block diagram showing configurations of the operation section base and a display operations section.

Further, FIG. 3 is a schematic block diagram showing a configuration of the operations section base 11 and the display operations section 14. As shown in FIG. 3, the display operations section 14 includes an LCD/touch panel 16 serving as a display unit and an input unit, a controlling unit 17 for transmitting a prescribed instruction item related to an operation selected through the LCD/touch panel 16 to the operations section base 11 through a communicating unit based on wired or wireless communications, and an instruction position detection unit 18 for detecting the position (distance, coordinate) of operation instruction means 15 such as a touch pen and a user's finger.

The controlling unit 17 changes a display mode (including positions, sizes, and combinations) of instruction items displayed on the LCD/touch panel 16 in accordance with the detection signal representing the distance between the instruction item and the operation instruction means 15. The controlling unit 17 also changes the display mode depending on a situation whether each of the display operations section 14 and another operations section (the second operations section 13) is mounted on the operations section base 11.

Figure 4:
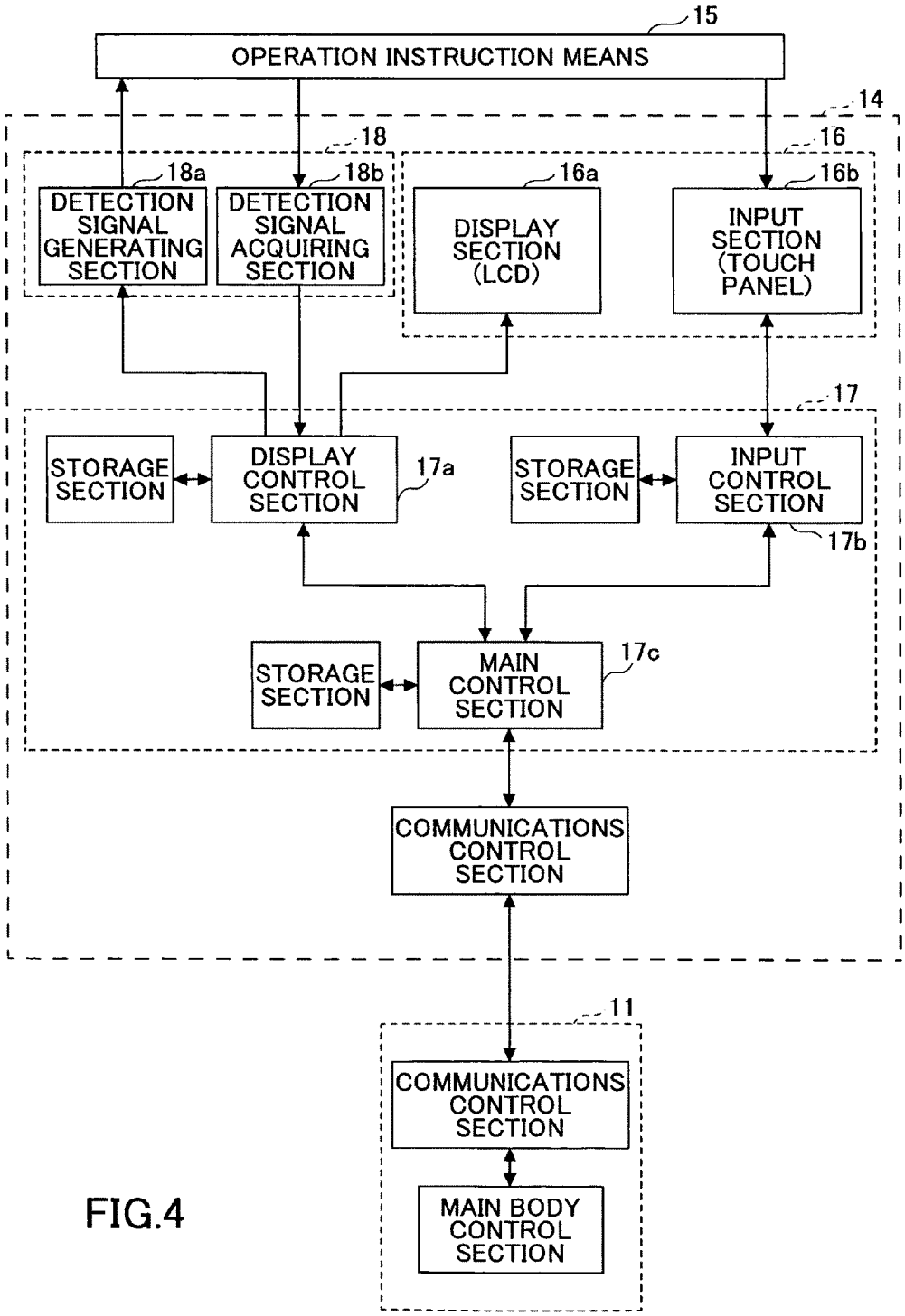
FIG. 4 is another schematic block diagram showing a configuration of the display operations section.

FIG. 4 is a block diagram showing a more detailed configuration of the display operations section 14. As shown in FIG. 4, in the display operations section 14, the LCD/touch panel 16 includes a display section 16*a* and an input section 16*b*; the controlling unit 17 includes a display control section 17*a*, an input control section 17*b*, and a main control section 17*c*; and the instruction position detection unit 18 includes a detection signal generating section 18*a* and a detection signal acquiring section 18*b*. There is a storage section for the display control section 17*a*. This storage section stores, for example, a control program for the entire display operations section 14 and a program for controlling the display operations section 14 for calculating the position of the operation instruction means 15.

Further, there is another storage section for the display control section 17*a*. This storage section stores, for example, a program for controlling a display section (LCD) 16*a*, an initial display menu (for example, basic display mode before being enlarged) of the instruction items (soft keys), display image information for a changed and an enlarged display mode, position information input from the input section (the touch panel) 16*b*.

Further, there is still another storage section for the input control section 17*b*. This storage section stores, for example, a control program for acquiring touch position information when the input section (touch panel) 16*b* is used and the thus-acquired position information (coordinate information).

Then, based on the program stored in the storage section for the main control section 17*c*, the main control section 17*c* controls the display control section 17*a* and the input control section 17*b*, and is in communication with the operations section base 11 and the image forming apparatus though the operations section base 11. It should be noted that it may not always be necessary to have the display control section 17*a* and the input control section 17*b* separately, namely the main control section 17*c* may include the control functions of the display control section 17*a* and the input control section 17*b*. However, in the embodiments of the present invention, the display control section 17*a*, the input control section 17*b*, and the main control section 17*c* are separately provided for illustrative purposes only.

The display control section 17*a* displays instruction items (soft keys) and various information (such as error information and status information) from a main body of the apparatus (operations section base 11 and the image forming apparatus) and the display operations section 14 itself on a display device (display section 16*a*) such as an LCD.

The input control section 17*b* acquires touch position matrix information of the input section (touch panel) 16*b*, and stores and transmits the acquired information as coordinate information to the main control section 17*c*, so that the main control section 17*c* determines which instruction item (soft key) is selected based on the coordinate information.

Further, the instruction position detection unit 18 for detecting the position of the operation instruction means 15 includes at least three outputs (provided at, for example, different positions from each other on the display operations section 14). The position of the operation instruction means 15 is calculated based on the signals detected by the detection signal acquiring section 18*b* in the instruction position detection unit 18. The calculation method is described below, and as a result of the calculation based on the detected signals, the coordinate position (x,y) of the operation instruction means 15 and the distance (height "h") between the operation instruction means 15 and the display section 16*b* are obtained. The obtained data are stored in the storage section for the display control section 17*a* as the position information of the operation instruction means 15.

Then, to display an image including the instruction items on the display section 16*a*, the main control section 17*c* reads the information of the instruction items in a basic display mode or a changed display mode (where the display mode is changed, for example, in colors, brightness, or using a highlighted, blinking, and enlarged displaying method) and transmits the read data to the display section 16*a* as the image information.

The input section 16*b* detects and inputs the position information as the coordinate information. In the embodiment of the present invention, a general display with a touch panel is used and the input of an instruction item is detected when the corresponding soft key is selected. Instead of using the touch panel, a device where a panel with evaporated electrodes is in front of the display section 16*a* may be used. In this case, the area where the touch sensor is disposed may be on the whole area or only a prescribed area of the display section 16*a*.

The input can be detected based on, for example, the change of inductance or electrical capacitance when the operation instruction means 15 touches or approaches the touch sensor. The principle of the touch sensor is similar to a general touch switch, therefore the description of the operations of the touch sensor is omitted.

It should be noted the main control section 17*c* may include and execute all or a part of the functions described above including the functions of the display control section 17*a* and the input control section 17*b*.

According to the embodiment of the present invention, when the operation instruction means 15 approaches the instruction item in the display section 16*a*, the display including the instruction item is enlarged in accordance with the distance between the operation instruction means 15 and the display section 16*a* as described below to improve the visibility of the display on the display section 16*a*, so that even a user with color vision deficiency or weak sightedness may easily operate the apparatus.

When one instruction item (soft key) is enlarged on the display section 16*a*, only the enlarged instruction item may be displayed on the whole screen area of the display section 16*a*. In this case, the recognition area for the instruction item is also enlarged according to the enlargement of the instruction item. By doing this, it becomes possible for a user to select the instruction item by touching any part of the touch sensor on the display section 16*a*, thereby facilitating the operability of the display operations section 14. Further, from a technical point of view, it becomes unnecessary to carry out complex scanning control for detecting a signal as with a general purpose touch panel. Further, when the enlarge display function is employed, the total size of the unit including the display section 16*a* and the input section 16*b* may be reduced without sacrificing the operability of the display operations section 14.

In the following, exemplary display modes on the display operations section (LCD/touch panel) 14 are described depending on whether each of the display operations section 14 and the second operations section 13 is mounted on the operations section base 11.

Figures 5A, 5B, 5C:
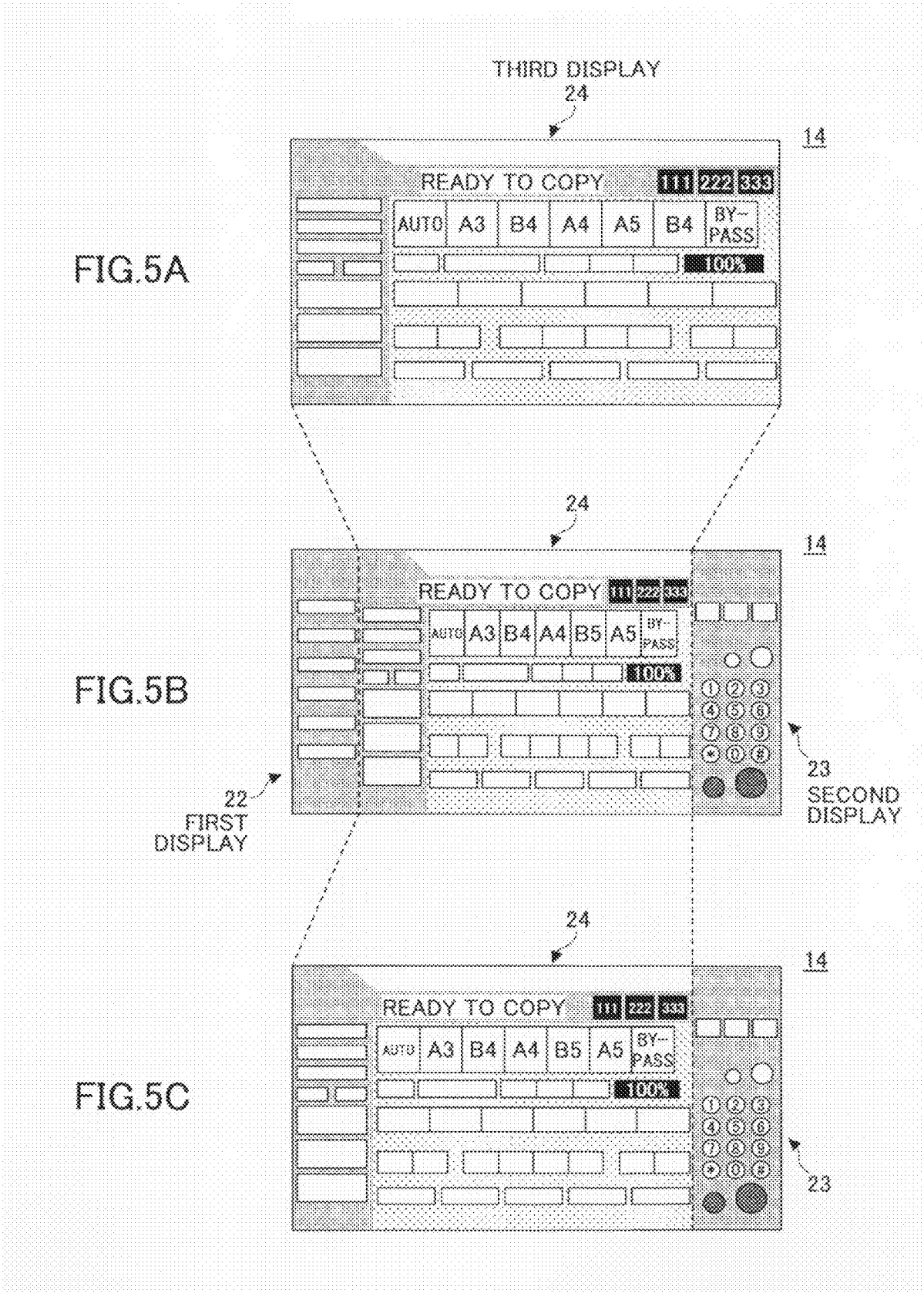
FIG. 5A is a drawing showing a display sample on the display operations section (LCD/touch panel) when the display operations section and the second operations section are mounted on the operations section base as shown in FIG. 2A.
FIG. 5B is a drawing showing a display sample on the display operations section (LCD/touch panel) when the display operations section is separated from and the second operations section is mounted on the operations section base as shown in FIG. 2B.
FIG. 5C is a drawing showing a display sample on the display operations section (LCD/touch panel) when the display operations section is mounted on and the second operations section is separated from the operations section base as shown in FIG. 2C.

More specifically, FIG. 5A shows an example of the display mode displayed on the LCD/touch panel 16 of the display operations section 14 when both the display operations section 14 and the second operations section 13 are mounted on the operations section base 11 as shown in FIG. 2A. In this case, only a third display 24 is displayed on the LCD/touch panel 16 as a basic display mode on which neither a first display 22 nor a second display 23 is displayed as shown in FIG. 5A. On the other hand, the first display 22 is displayed on the LCD/touch panel 16 when the display operations section 14 is separated from the operations section base 11, which enables a user to remotely operate the first operations section 12 on the separated display operations section 14. Further, the second display 23 is displayed on the LCD/touch panel 16 when either the display operations section 14 or the second operations section 13 is separated from the operations section base 11, which enables a user to remotely operate the second operations section 13 on the separated display operations section 14.

FIG. 5B shows an example of the display mode displayed on the LCD/touch panel 16 when the display operations section 14 is separated from the operations section base 11 but the second operations section 13 is still mounted on the operations section base 11 as shown in FIG. 2B. In this case, the first display 22 and the second display 23 are displayed on corresponding sides of the third display 24 on the LCD/touch panel 16 of the display operations section 14 as shown in FIG. 5B, so that a user can remotely operate the first and second operations sections 12 and 13 on the display operations section 14.

By doing this, when the display operations section 14 is separated from the main body of the apparatus, a user can operate all the operations by using the display operations section 14 only, thereby improving the operability of the apparatus. Further, the apparatus may include another display operations sections having the same functions of the display operations section 14. When the another display operations section is provided at the position on which the display operations section 14 is mounted on the operations section base 11, it becomes possible for another user to perform the same operations as those of the operations section base 11 on the main body of the apparatus while the display operations section 14 is separated from the operations section base 11.

FIG. 5C shows an example of the display example displayed on the LCD/touch panel 16 when the display operations section 14 is mounted on the operations section base 11 but the second operations section 13 is separated from the operations section base 11 as shown in FIG. 2C. In this case, only the second display 23 is displayed on a side of the third display 24 on the LCD/touch panel 16 of the display operations section 14 as shown in FIG. 5C, so that a user can remotely operate the second operations section 13 on the display operations section 14.

Figures 6A, 6B, 6C:
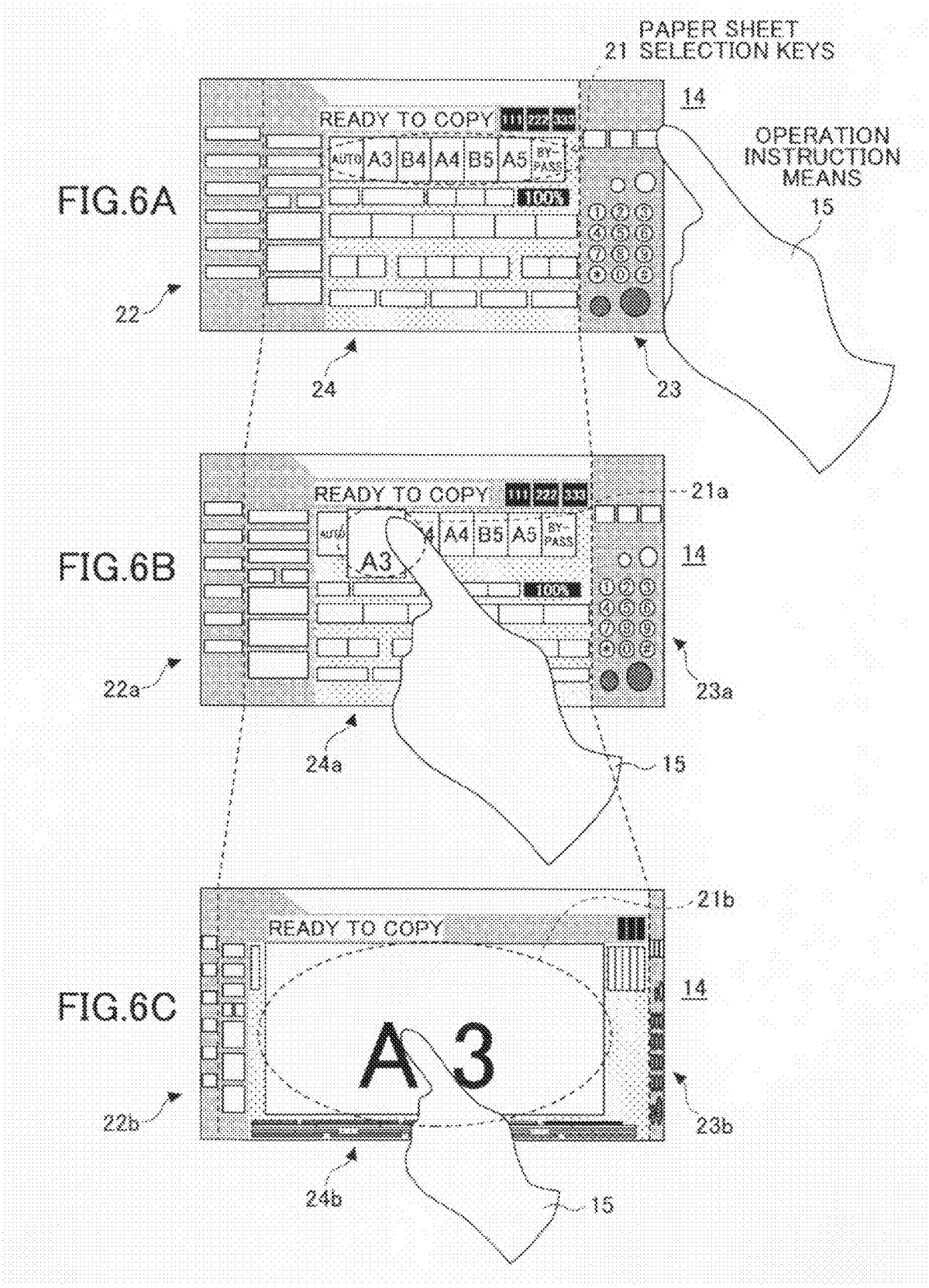
FIGS. 6A through 6C are drawings showing the change of the display mode by a display control unit.

FIGS. 6A through 6C show display modes according to a first embodiment of the present invention. As shown in FIGS. 6A through 6C, each size of the instruction items (soft keys) displayed on the LCD/touch panel 16 varies depending on the position of the operations instruction means 15 with respect to the LCD/touch panel 16 of the display operations section 14 and the distance between the operations instruction means 15 and the LCD/touch panel 16. Herein, the above position and the distance are detected by the instruction position detection unit 18, and the controlling unit 17 determines an appropriate display mode in accordance with the detected position and distance.

FIG. 6A shows an example of the display mode on the LCD/touch panel 16 when the distance between (the instruction item of) the display operations section 14, separated from the main body of the apparatus, and the operation instruction means 15 (a finger in this case) is still longer than a prescribed distance. Then, as shown in FIG. 6B when the operation instruction means 15 approaches an instruction item (paper sheet selection key display 21 in this case) on the LCD/touch panel 16 and the distance between the operation instruction means 15 and the instruction item is less than the prescribed distance, a paper sheet selection key (for selecting "A3" size paper sheet) is enlarged as shown by 21*a* in FIG. 6B. When the operation instruction means 15 further approaches the instruction item, the paper sheet selection key is further enlarged as shown by 21*b* in FIG. 6C.

As described above, the size of any instruction item (soft key) on the LCD/touch panel 16 may vary depending on the distance between the display operations section 14 and the operation instruction means 15 detected by the instruction position detection unit 18. Further advantageously, when the size of an instruction item (soft key) is enlarged to occupy most of the display section such as a case of the paper sheet selection key (for selecting "A3" size paper sheet) 21*b* in FIG. 6C, it becomes possible to select the instruction item (or press the soft key) (for selecting "A3" size paper sheet 21*b*) when a user touches any portion of the enlarged instruction item (soft key).

As shown in FIGS. 6A through 6C, in accordance with the change of the display mode of the instruction items of the third display 24, the display mode of the first display 22 and the second display 23 may be also changed as shown in 22*a* and 22*b* and 23*a* and 23*b*, respectively. It should be noted that the controlling unit 17 may change the size of each instruction item (soft key) in accordance with the coordinate position of the operation instruction means 15 with respect to each instruction item (soft key) and the distance between the operation instruction means 15 and the instruction item (soft key) just below the operation instruction means 15. The position and the distance are detected by the instruction position detection unit 18. The controlling unit 17 further changes each touching area on the LCD/touch panel 16 with respect to the corresponding instruction items (soft keys) in accordance with the above changed sizes of the instruction items (soft keys).

Figure 7A:
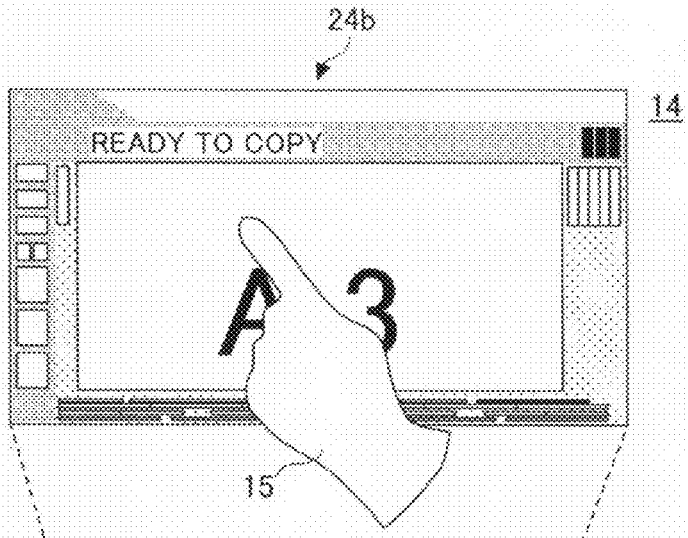
FIG. 7A is a drawing showing a display sample of an enlarged paper sheet selection key on the display operations section when the display operations section and the second operations section are mounted on the operations section base as shown in FIG. 2A.
Figure 7B:
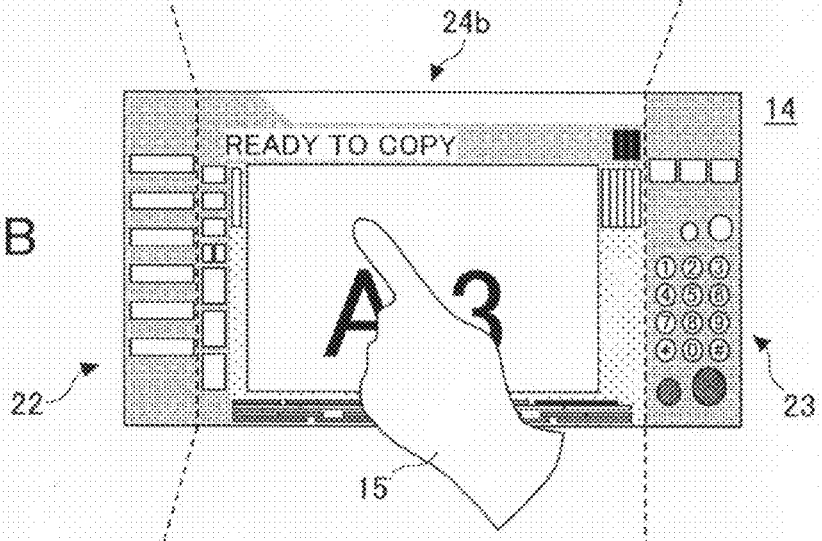
FIG. 7B is a drawing showing a display sample of an enlarged paper sheet selection key on the display operations section when the display operations section is separated from and the second operations section is mounted on the operations section base as shown in FIG. 2B.
Figure 7C:
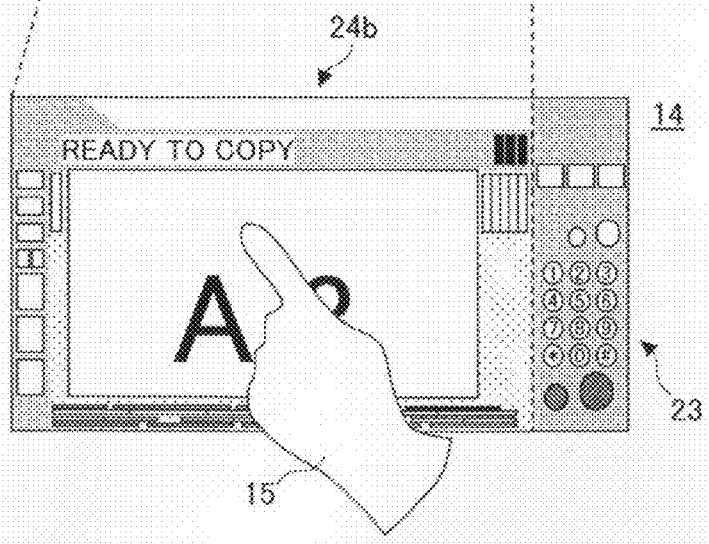
FIG. 7C is a drawing showing a display sample of an enlarged paper sheet selection key on the display operations section when the display operations section is mounted on and the second operations section is separated from the operations section base as shown in FIG. 2C.

FIGS. 7A, 7B, and 7C show display modes according to a second embodiment of the present invention. FIGS. 7A through 7C show examples of display mode where an instruction item (soft key) (in this case, the paper sheet selection key 24*b* of the third display 24*b*) is enlarged in each case where the display operations section 14 and the second operations section 13 are mounted on the operations section base 11 as shown in FIG. 2A, where the display operations section 14 is separated from the operations section base 11 but the second operations section 13 is mounted on the operations section base 11 as shown in FIG. 2B, and where the display operations section 14 is mounted on the operations section base 11 but the second operations section 13 is separated from the operations section base 11 as shown in FIG. 2C, respectively.

As shown in FIGS. 7A through 7C, the widths (in the right-to-left direction in figures) of the first display 22*b* and the second display 23*b* are substantially unchanged (not reduced) even when the instruction item (soft key) (the paper sheet selection key 24*b* of the third display 24*b*) is enlarged as shown in FIG. 6C. This feature may be advantageous because, when the width of the first display 22 and the second display 23 is reduced due to the enlarged instruction item (soft key) as shown in FIG. 6C, a user may face difficulty in operating an application key (to select an application) on the first operations section 12 and the ten keys and the start keys on the second operations section 13 as the next operation. Each of such keys may be frequently used in typical operations.

To solve the problem, according to this embodiment of the present invention, the width of the first display 22 including, for example, the application keys and the second display 23 including, for example, the ten keys and the start key with respect to the third display 24 is substantially fixed so that the display mode of the first display 22 and the second display 23 is unchanged as shown in FIGS. 7B and 7C. By doing this, a user can recognize the position to be operated on the first display section 22 and the second display sections 23 more easily after operating the display operations section 14, thereby improving the operability of the apparatus.

Figure 8A:
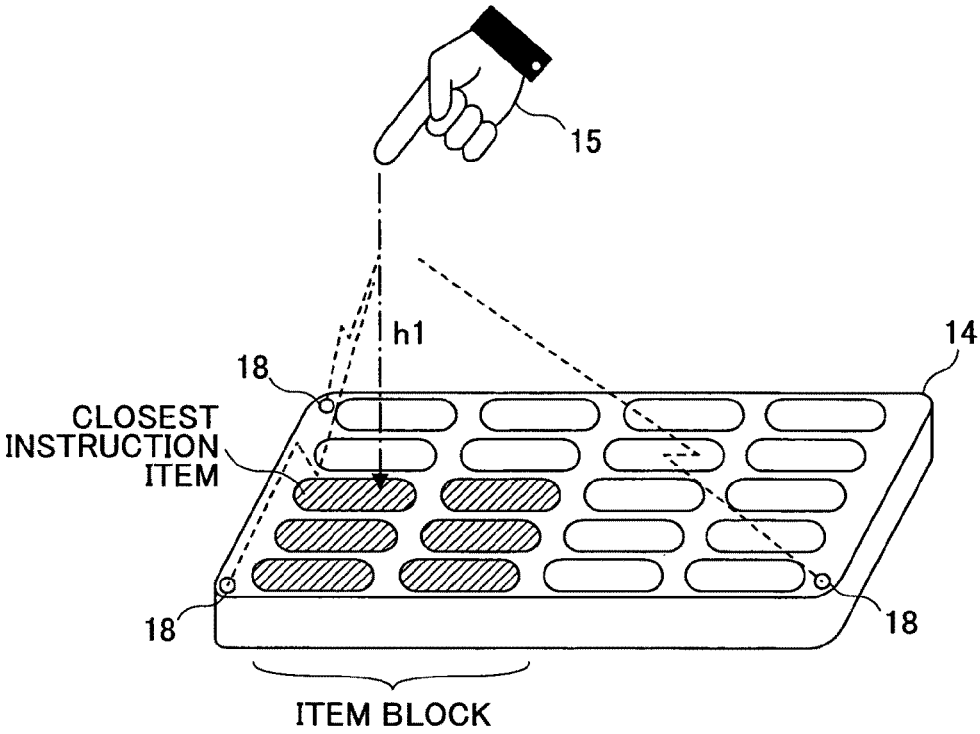
FIGS. 8A and 8B are drawings each illustrating the distance between the display operations section and operation instruction means.
Figure 8B:
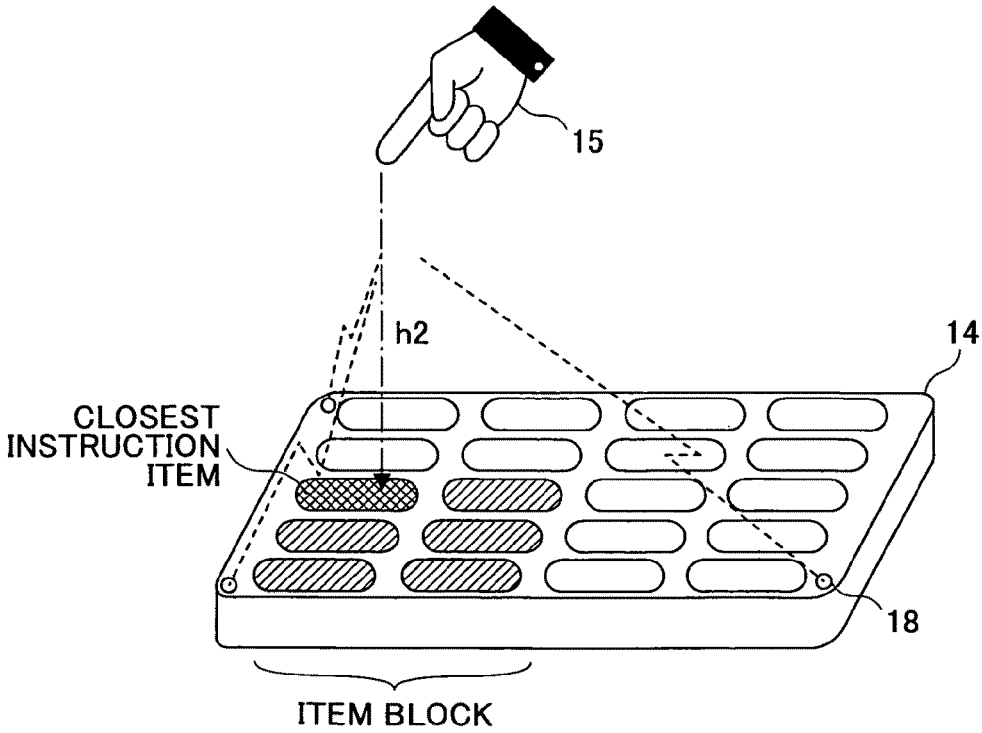

FIGS. 8A and 8B show display modes according to a third embodiment of the present invention. As shown in FIG. 8A, plural instruction items (soft keys) are divided into plural block groups (hereinafter referred to as item blocks). When the operation instruction means 15 approaches the display operations section 14 and the distance between the operation instruction means 15 and the display operations section 14 reaches a predetermined distance "h1", the instruction position detection unit 18 determines at which item block the operation instruction means 15 is aiming. Based on the result of this determination by the instruction position detection unit 18, the display mode of the determined item block is changed so as to be easily distinguished from the other item blocks. By doing this, a user can easily recognize whether a desired function to be selected is included in the determined block item.

Further, when the operation instruction means 15 approaches the display operations section 14, the display mode is changed so that the size of the item block determined as the item block at which the operation instruction means 15 is aiming is enlarged to a level where even a user with weak vision or an aged user may read more easily. By this arrangement allowing a user to operate based on the enlarged display, the operability of the apparatus may be improved. The display may be enlarged up to the full display size. For example, each of the keys may be enlarged so that all the ten keys are enlarged up to and included in the full display size. Further, as shown in FIG. 8B, in addition to enlarging the display of the item block, the display mode of the instruction item (soft key) closest to the operation instruction means 15 may be further changed. Specifically, a further different display mode may be selected for the instruction item closest to the operation instruction means 15. To this end, touch panels, touch sensors, or the like may be on the display items, and the detection area of the instruction item may be accordingly enlarged in accordance with the enlargement of the display items, thereby enabling the input operation based on the enlarged instruction item.

Figures 9A, 9B, 9C:
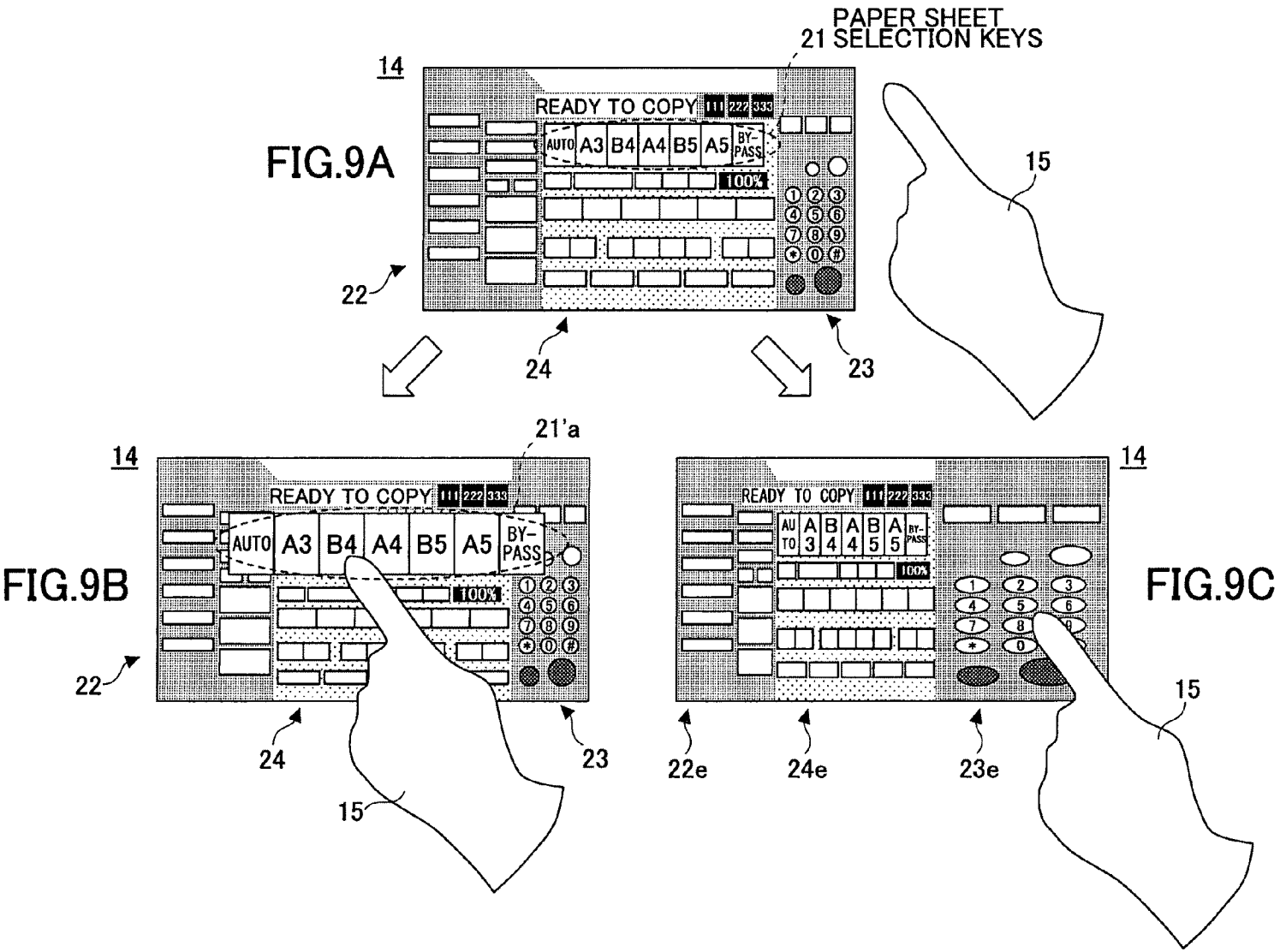
FIG. 9A is a drawing showing a display sample on the display operations section when the operation instruction means is separated from the instruction item to be selected on the display operations section.
FIG. 9B is a drawing showing a display sample on the display operations section when the operation instruction means is above the paper sheet selection keys.
FIG. 9C is a drawing showing a display sample on the display operations section when the operation instruction means is above a second display.

Further, FIGS. 9A through 9C show additional display modes according to an embodiment of the present invention. FIG. 9A shows an example of display mode when the operation instruction means 15 is still separated from any of the instruction items (soft keys) on the display operations section 14. FIG. 9B shows an example of display mode when the operation instruction means 15 is in contact with the paper sheet selection keys on the third display 24. FIG. 9C shows an example of display mode when the operation instruction means 15 is in contact with the second display 23.

As shown in FIG. 9B, when the operation instruction means 15 selects an instruction item (soft key) (in this case a paper sheet selection key), the item block including the instruction items (soft keys) having common functions (such as ten keys, double-sided printing key, and other function keys) including the instruction item (soft key) to that of the instruction selected by the operation instruction means 15 is enlarged even if the area of the enlarged item block superimposes the areas of first, second, and third displays 22, 23, and 24. In the case as shown in FIG. 9B, the item block including the paper sheet selection keys is enlarged so as to superimpose the second display 22. Further, as shown in FIG. 9C, when the operation instruction means 15 is in contact with the second display 23 having the functions of the second operations section 13 including the ten keys and the start key, the second display 23 may be enlarged as shown in the second display 23*e* in FIG. 9C.

By doing this, when a user selects an instruction item (soft key), the relevant instruction items (soft keys) in the same item block are also enlarged and displayed, thereby enabling a user to select an instruction item (soft key) more effectively and improving the operability of the apparatus.

Further, unlike any of the embodiments described above where a single instruction item (soft key) or an item block including common instruction items (soft keys) is enlarged, the instruction items (soft keys) may be enlarged by using, for example, a zoom lens with respect to the detected position on or above which the operation instruction means 15 is positioned as the center of the enlargement. By doing this, it may also be possible to achieve the improvement of the operability of the apparatus.

In first through third embodiments of the present invention described above, the change of display mode is described depending on cases where each of the operations sections (the second operations section 13 and the display operations section 14) is separated. In addition, when plural users use the same image forming apparatus in, for example, an office environment, the users may be identified by using IDs. By doing this, it becomes possible to provide individual settings for each user, thereby further improving the operability for each of the users.

Next, a method of calculating the distance and the coordinate position of the operation instruction means 15 detected by the instruction position detection unit 18 to locate the position of the operation instruction means 15 with respect to the display operations section 14 is described. As the instruction position detection unit 18 shown in FIG. 3, for example, both a device emitting ultrasonic waves or electromagnetic waves and a sensor detecting the reflected waves from the operation instruction means 15 are allocated in plural positions on the LCD/touch panel 16 so as to detect the distance between the operation instruction means 15 and each sensor. Based on the detected distances, the three-dimensional position of the operation instruction means 15 is calculated. The three-dimensional position herein refers to the distance (height) "h" with respect to the display operations section 14 and the (x,y) coordinate position projected onto the surface of the LCD/touch panel 16.

The distance "h" is exactly the distance between the operation instruction means 15 and the display operations section 14. The (x,y) coordinate position provides a positional relationship between the operation instruction means 15 and each of the instruction items (soft keys). Further, based on the (x,y) coordinate position, the instruction item (soft key) closest to the operation instruction means 15 is obtained.

Figure 10:
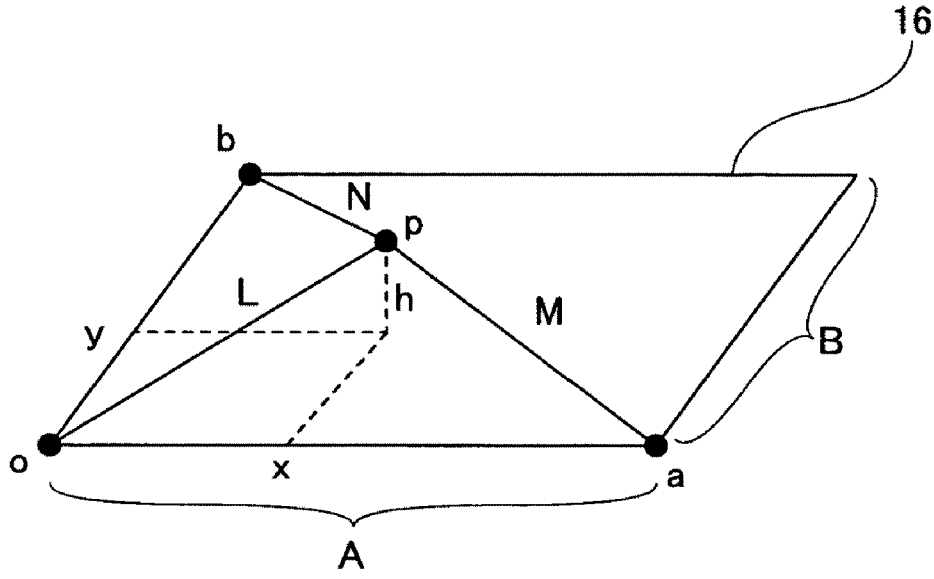
FIG. 10 is a drawing illustrating positional relationships among the points necessary for calculating the distance "h" and coordinate position (x,y) when the operation instruction means is above the display operations section.

FIG. 10 shows an exemplary calculation method for obtaining the distance "h" and the (x,y) coordinate position. As shown in FIG. 10, the symbols "A" and "B" denote the horizontal size and the vertical size, respectively, of the LCD/touch panel 16. A pair of the devices for emitting ultrasonic waves or electromagnetic waves and the sensor for receiving the waves is installed at each of the three points "o", "a", and "b" on the LCD/touch panel 16. With this configuration, when the point "p" denoting the position of the operation instruction means 15 is given, each of the distances "L" (between points "o" and "p"), "M" (between points "a" and "p"), and "N" (between points "b" and "p") can be obtained by measuring the time difference from when the wave is emitted until when the wave reflected from the point "p" (position of the operation instruction means 15) is received.

Since the distances among the sensors (sizes of the LCD/touch panel 16) are known, when the distances "L", "M", and "N" are obtained, the distance "h" and the (x,y) coordinate position can be calculated by the following equations 1.

[EQUATION 1]

$$x = \frac{(A^2 - M^2 + L^2)}{2A}$$

$$y = \frac{(B^2 - N^2 + L^2)}{2B}$$

$$h = \sqrt{(L^2 - x^2 - y^2)}$$

An interference problem may be avoided by separately emitting the waves from each point or using different wavelengths among the points.

Further, as another method of detecting the position of the operation instruction means 15, a parallel light beam as described in Patent Document 7 may be used by detecting the position where the beam is cut off. The distance to the operation instruction means 15 may also be detected in accordance with the obtained focal distance by using techniques of a camera function and image processing.

Figure 11:
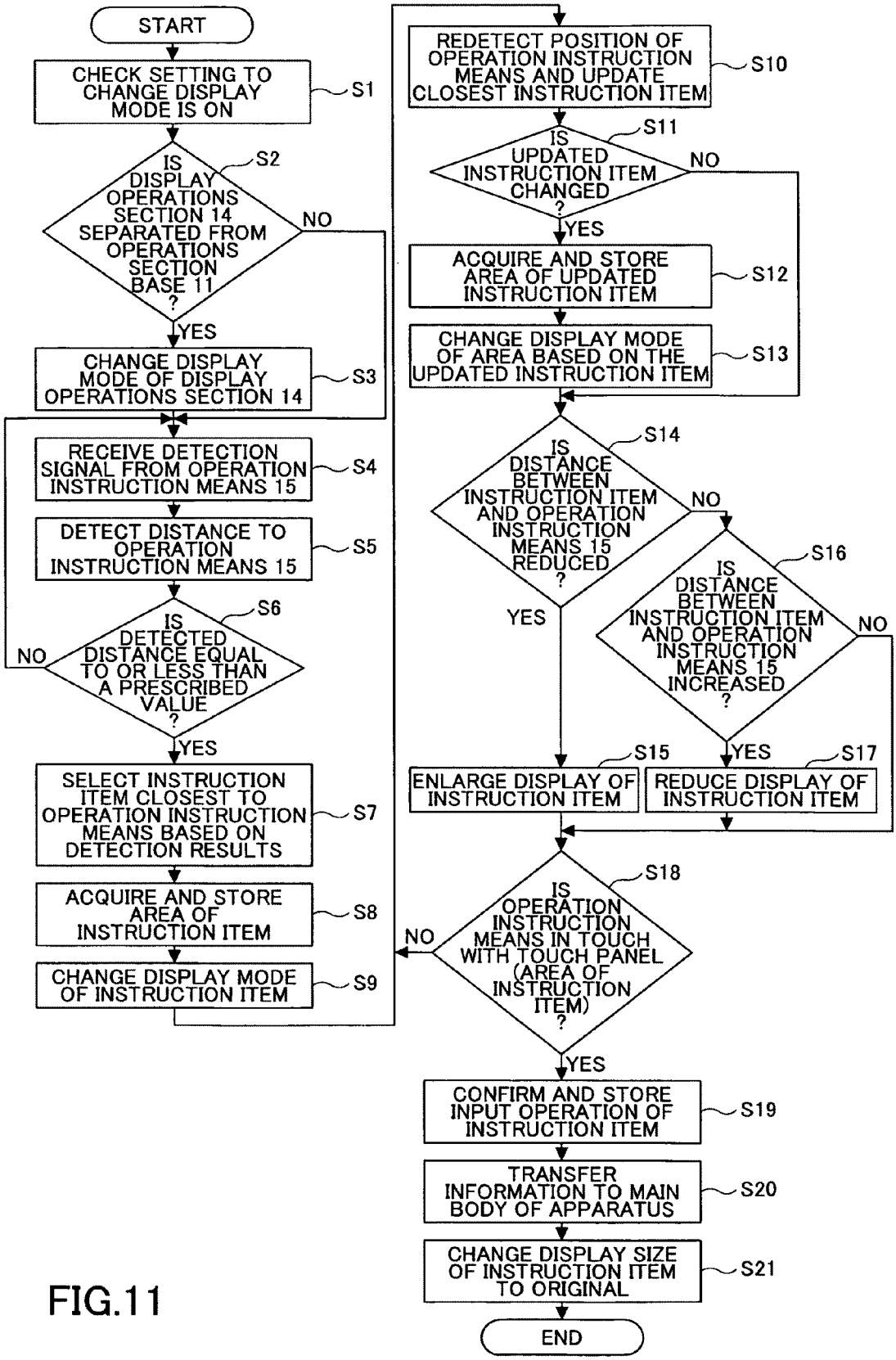
FIG. 11 is a flowchart showing a controlling process of detecting the coordinate position of and the distance to the operation instruction means and changing the display mode.

FIG. 11 is a flowchart showing a process of changing a display mode based on the calculation results of the coordinate position of and the distance to the operation instruction means 15. In this process, as shown in FIG. 11, the display mode changes depending on, for example, whether the display operations section 14 is mounted on the operations section base 11 and the distance between the operations panel (LCD/touch panel 16) and the operation instruction means 15.

First, the controlling unit 17 determines whether a setting of changing the display mode is activated (step S1). The following step is performed when the setting is activated. Then, it is determined whether the display operations section 14 is separated from the operations section base 11 (step S2). When it is determined that the display operations section 14 is separated from the operations section base 11 (YES in step S2), the display menu on the LCD/touch panel 16 of the display operations section 16 is changed as shown in from FIG. 5A to FIG. 5B (step S3).

The controlling unit 17 receives a detection signal of the operation instruction means 15 from the instruction position detection unit 18 (step S4), and calculates the coordinate position of the operation instruction means 15 and the distance between the operation instruction means 15 and an instruction item displayed on the LCD/touch panel 16 (step S5). Then, it is determined whether the calculated distance is equal to or less than a prescribed value (step S6). When it is determined that the calculated distance is equal to or less than a prescribed value (Yes in step S6), an instruction item closest to the operation instruction means 15 is selected based on the calculation result (step S7). Then, the area information of the selected instruction item is acquired and stored (step S8). Then, the display mode of the area of the instruction item is changed as shown in FIG. 6B (step S9).

Further, the coordinate position of the operation instruction means 15 is updated and the updated instruction item closest to the operation instruction means 15 is selected (step S10). Then, it is determined whether the updated instruction item is changed from the previous instruction item selected in step S7 (step S11). When it is determined that the updated instruction item is changed from the previous instruction item (Yes in step S11), the area information of the updated instruction item is acquired and stored (step S12). Further, based on this change, the display mode of the updated instruction item is changed (for example display is changed from the "A3" paper sheet selection key as shown in FIG. 6B to another key) (step S13).

Further, it is determined whether the distance between an instruction item and the operation instruction means 15 is reduced (step S14). When it is determined that the distance is reduced (Yes in step S14), the size of the instruction item is further enlarged as shown in FIG. 6C (step S15). On the other hand, when it is determined that the distance is not reduced (No in step S14), it is next determined whether the distance between an instruction item and the operation instruction means 15 is increased (step S16). When it is determined that the distance is increased (Yes in step S16), the size of the instruction item is reduced as shown in FIG. 6A (step S17).

Next, it is determined whether the operation instruction means 15 is in contact with the LCD/touch panel 16 (area of enlarged instruction item) (step S18). When it is determined that the operation instruction means 15 is in contact with the LCD/touch panel 16 (Yes in step S18), the input operation with respect to the instruction item is confirmed and the instruction item is stored (step S19). Then, the information of the confirmed instruction item is transmitted to the main body of the apparatus (step S20) and the size of the instruction item is returned to its original size (step S21). The purpose of this step S21 is to inform a user that the apparatus receives the input operation of the instruction item and carries out the following necessary process in response to the input operation. Then, again, when it is determined that the operation instruction means 15 is above the display operations section 14, the above process is repeated and the display mode may be changed as needed.

Next, a process of changing the display mode of the item block including plural instruction items (soft keys) is described with reference to FIGS. 8A, 8B, and 9. The methods of changing the display may be, for example, changing colors and brightness of the instruction item and highlighting, blinking, and enlarging the instruction item. In this example, however, a method of enlarging the instruction item is representatively described.

FIGS. 12A through 12E and 13A through 13E show the change of display mode of the instruction item and the item block including plural instruction items on the display operations section 14. More specifically, FIGS. 12A through 12E show examples that, when an instruction item (soft key) of an instruction block is selected, the selected instruction item (soft key) and the item block including the selected instruction item (soft key) are enlarged, and accordingly, the size of the other instruction items (soft keys) in the other item blocks are reduced. On the other hand, in FIGS. 13A through 13E shows examples where not only the selected instruction item and the item block including the selected instruction item but also the other instruction items in the other item blocks are equally enlarged.

Upon the enlargement of an instruction item (soft key) in an item block and the item block including the instruction item (soft key), it is assumed that the instruction item (soft key) closest to the operation instruction means 15 is the center of the enlargement. However, there may be two cases of selecting the position of the center of the enlargement depending on the position of the instruction item (soft key) to be enlarged. One case is that the instruction item (soft key) closest to the operation instruction means 15 is located at the end of the LCD/touch panel 16 of the display operations section 14 as shown in FIGS. 12B, 12C, 13B, and 13C. The other case is that the instruction item (soft key) is located other than at the end of the LCD/touch panel 16 as shown in FIGS. 12D, 12E, 13D, and 13E. When the instruction item (soft key) is located at the end of the of the LCD/touch panel 16, enlargement may be performed by setting the edge of the instruction item as the center of the enlargement, the edge being contiguous to the boundary of the LCD/touch panel 16 as shown in FIGS. 12B and 12C and FIGS. 13B and 13C. On the other hand, when the instruction item (soft key) is located other than at the end of the LCD/touch panel 16, enlargement may be performed by setting the center of the instruction item as, for example, the center of the enlargement as shown in FIGS. 12D and 12E and FIGS. 13D and 13E. By doing this, the enlarged instruction item (soft key) including the center of the enlargement has a higher probability of still being included in the display of the LCD/touch panel 16 after the enlargement.

Even when the instruction item (soft key) including the center of the enlargement is located other than at the end of the LCD/touch panel 16 is enlarged, an edge of the enlarged instruction item (soft key) may protrude beyond the boundary of the LCD/touch panel 16. To solve this problem, simulation of the enlargement may be previously performed to determine whether any edge of the instruction item (soft key) would protrude beyond the boundary of the LCD/touch panel 16. In this simulation, when it is determined that any edge of the instruction item (soft key) would protrude beyond the boundary of the LCD/touch panel 16, the center of the enlargement may be moved so as not to protrude beyond the boundary of the LCD/touch panel 16.

Figure 12A:
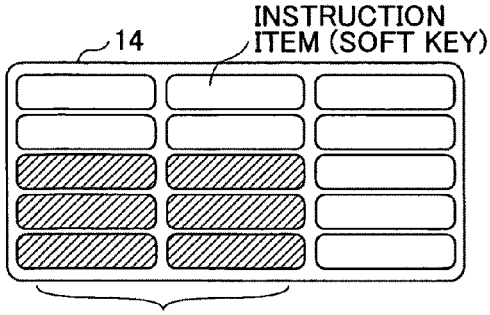
FIGS. 12A through 12E are drawings showing changes of the display mode.
Figure 12B:
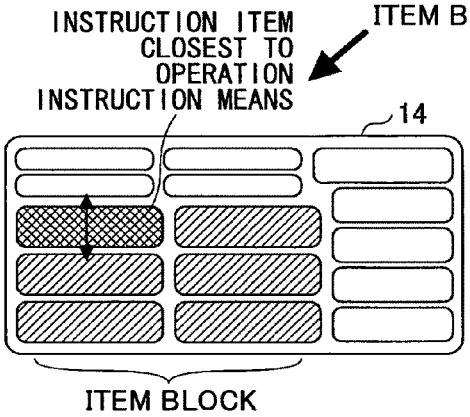
Figure 12D:
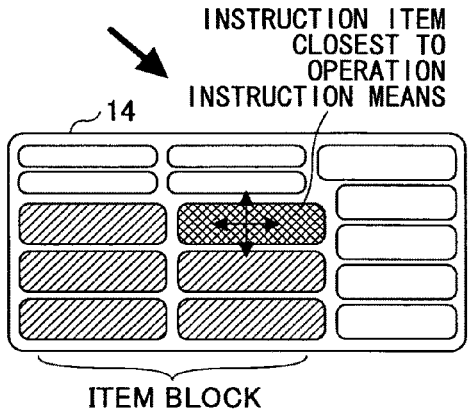
Figure 12C:
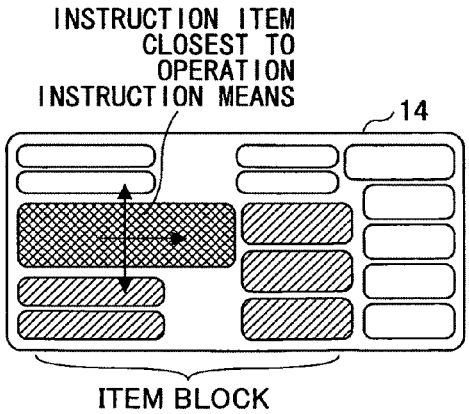
Figure 12E:
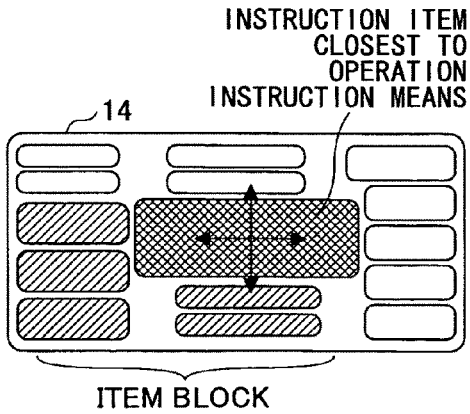
Figure 13A:
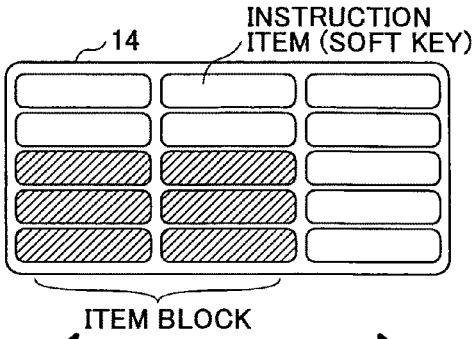
FIGS. 13A through 13E are drawings showing other changes of the display mode.
Figure 13B:
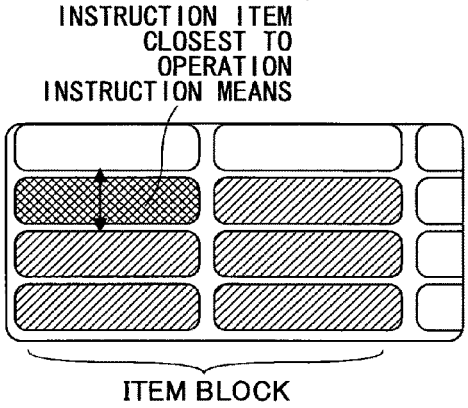
Figure 13D:
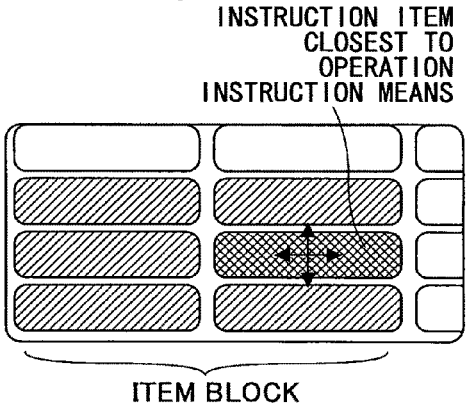

Further, when the enlargement is performed, the size of the instruction items (soft keys) in the block items other than the block item including the instruction item (soft key) closest to the operation instruction means 15 may be reduced as shown in FIGS. 12D and 12E, so that the instruction items (soft keys) have a higher probability of remaining on the LCD/touch panel 16. Further, when the entire of the instruction items (soft keys) is excluded from the display of the LCD/touch panel 16, the instruction items (soft keys) are not displayed as shown in FIGS. 13D and 13E.

Figure 14:
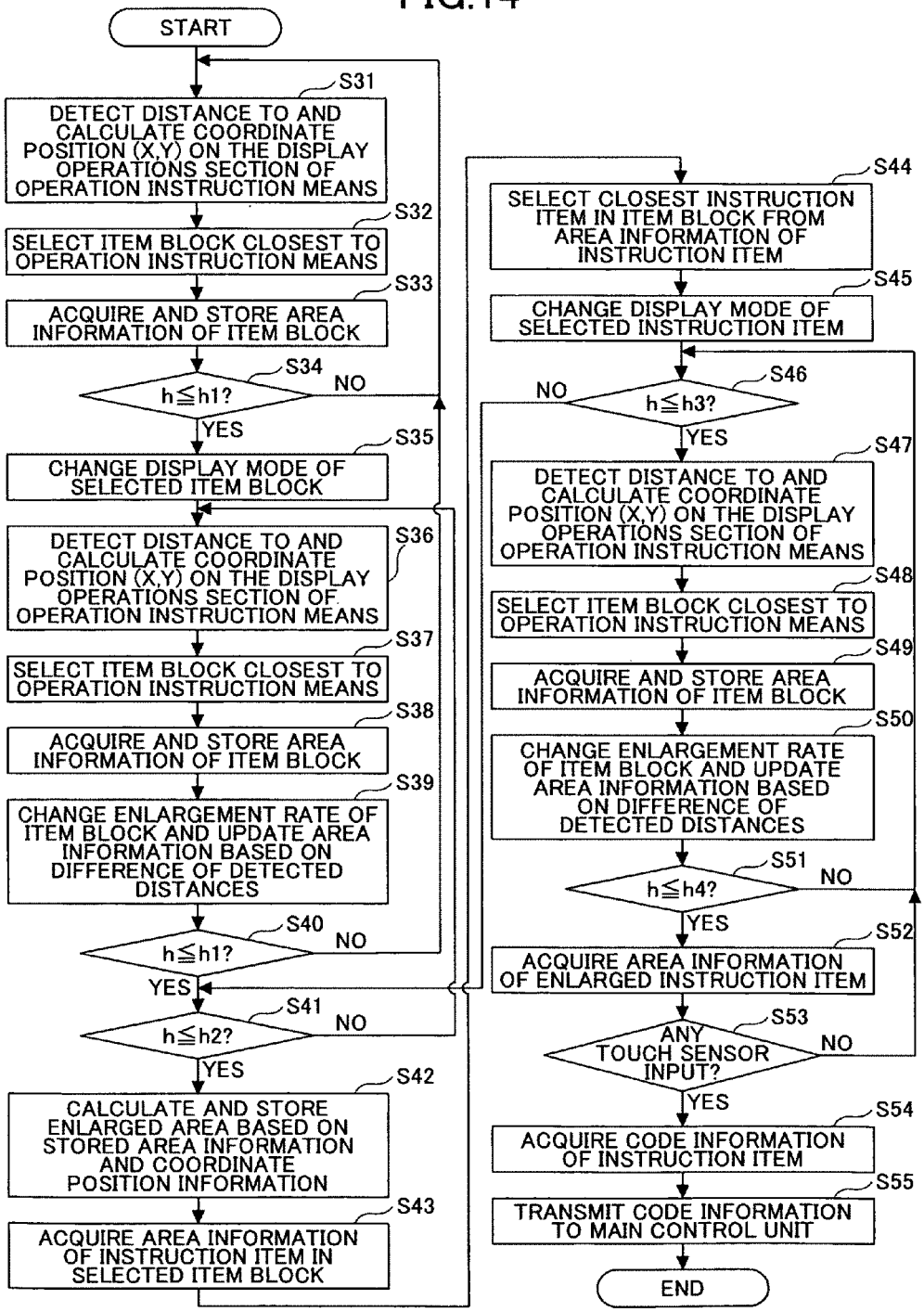
FIG. 14 is a flowchart showing a controlling process of changing the display mode of the display on the display operations section.

FIG. 14 is another flowchart showing a process of changing a display mode based on the calculation results of the coordinate (position) of and the distance to the operation instruction means 15. In this process, first, the distance (height) "h" and the coordinate position (x,y) (see FIG. 10) of the operation instruction means 15 with respect to the LCD/touch panel 16 of the display operations section 14 are detected by the instruction position detection unit 18 (step S31).

Then, the item block including the instruction item (soft key) closest to the operation instruction means 15 is selected (step S32). The area information of the selected item block is acquired and stored (step S33). It should be noted that the area information of each instruction item (soft key) and each item block including plural instruction items (soft keys) is updated in accordance with the change of the enlargement rate with respect to the initial area information of each instruction item described below.

Figure 15:
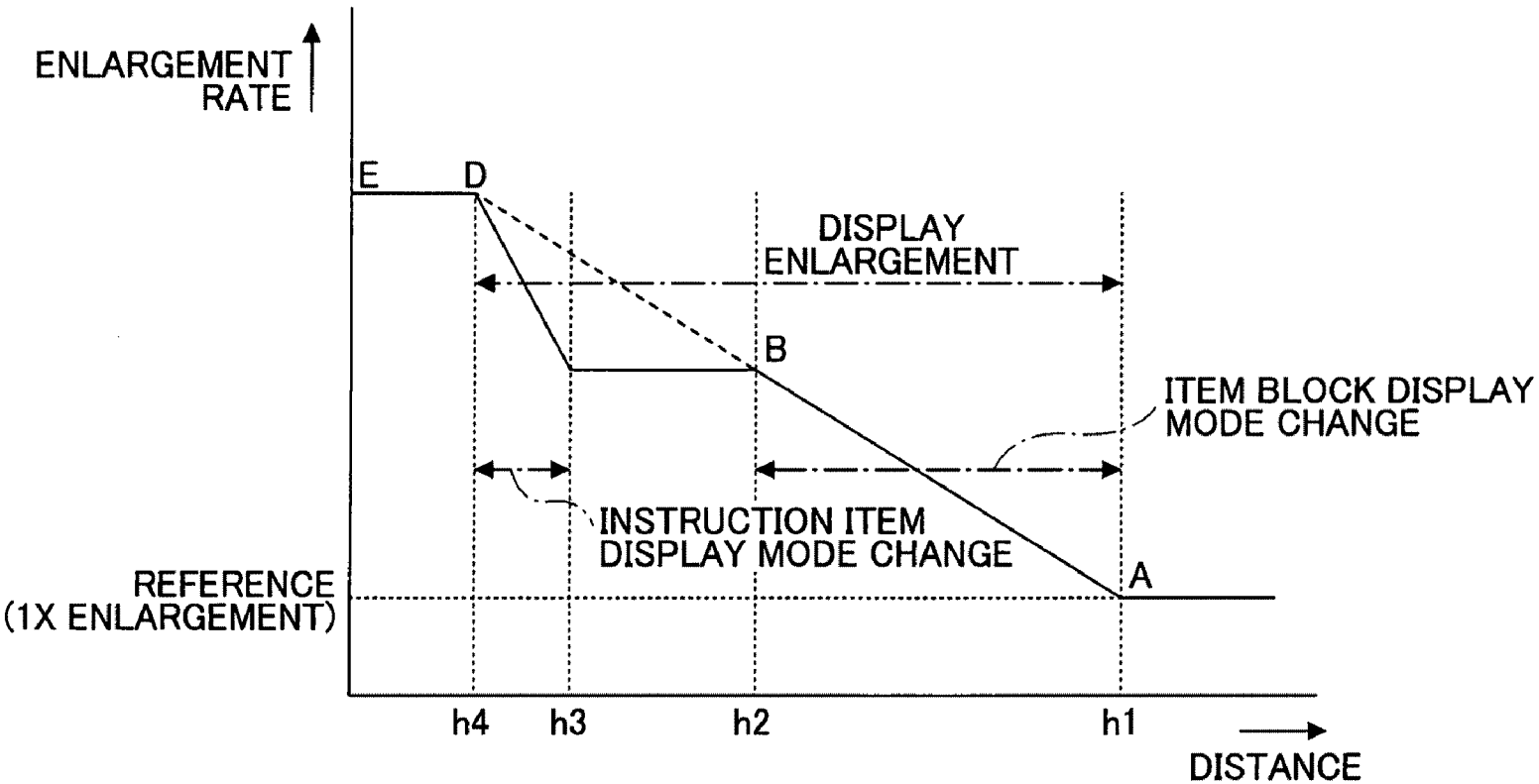
FIG. 15 is a drawing showing a relationship between the distance to the operation instruction means and an enlargement rate.

Next, it is determined whether the distance "h" to the operation instruction means 15 detected by the instruction position detection unit 18 is equal to or less than a prescribed distance "h1" as shown in FIG. 15 illustrating the change of enlargement rate with respect to the distance to the operation instruction means 15 (step S34). When it is determined that the distance "h" exceeds the prescribed distance "h1" (No in step S34), the process goes back to step S31. On the other hand, when it is determined that the distance "h" is equal to or less than the prescribed distance "h1" (Yes in step S34), the display mode of the selected item block is changed as shown in FIG. 12A (step S35).

Further, based on the distances to the operation instruction means 15, the coordinate position (x,y) on the surface of the display operations section 14 is calculated in the same manner as in steps S31 through S33 (step S36), and the item block including the instruction item (soft key) closest to the operation instruction means 15 is selected (step S37). In this case, when the movement of the operation instruction means 15 is detected and accordingly the item block including the instruction item (soft key) closest to the operation instruction means 15 is changed, the display mode of the updated item block is changed and the display mode of the previous item block is returned to the original display mode. By doing this, it becomes possible for a user to recognize the change of the position of the operation instruction means 15 with respect to the display operations section 14. The area information of the selected item block is acquired and stored in the storage section (step S38). Based on the difference between the distances detected in step S31 and the distance detected in step S36, the enlargement rate of the item block is updated, and, based on the updated enlargement rate, the area information is updated and the display mode is accordingly changed (step S39). It should be noted that the enlargement rate of the instruction items (soft keys) and each size of the display (first through third displays 22 through 24) with respect to the distance "h1" to the operation instruction means 15 are to be previously determined.

Next, when the detected distance "h" to the operation instruction means 15 exceeds the distance "h1" (No in step S40), the area information is returned to its original area information so as to return the size of the instruction item (soft key) to its original size and the process goes back to step S31. On the other hand, when the distance "h" is equal to or less than the distance "h1" and exceeds another prescribed distance "h2" (No in step S41), the process goes back to step S36 to repeat the process of changing the display mode with respect to the selected item block.

On the other hand, when the distance "h" is equal to or less than the distance "h2" (Yes in step S41), the area information of the selected item block and the enlarged area information of the item block calculated based on the detected position of the operation instruction means 15 are stored in the storage section (step S42). In this case as well, when the movement of the operation instruction means 15 is detected and accordingly the item block including the instruction item (soft key) closest to the operation instruction means 15 is changed, the display mode of the updated item block is changed and the display mode of the previous item block is returned to its original display mode. By doing this, it becomes possible for a user to read and make sure, for example, the function of each instruction item (soft key) easily.

Then, the area information of each instruction item (soft key) in the selected item block is acquired (step S43). Further, based on the acquired area information of the instruction items (soft keys), the instruction item (soft key) closest to the operation instruction means 15 is selected in the same manner as in steps S31 and S36 (step S44), and the display mode when the selected instruction item (soft key) is changed as shown in FIGS. 12B and 12D (step S45).

Further, it is determined whether the detected distance "h" to the operation instruction means 15 is equal to or less than still another prescribed distance "h3" (step S46). When it is determined that the distance "h" exceeds the distance "h3" (No in step S46), the process goes back to step S41 to compare the distance "h" with the distance "h2" again. On the other hand, when it is determined that the distance "h" is equal to or less than the distance "h3" (Yes in step S46), the distance to the operation instruction means 15 is detected and the coordinate position (x,y) on the display operations section 14 are calculated (step S47). Based on the detected distance and the calculated coordinate position (x,y), the instruction item (soft key) closest to the operation instruction means 15 is selected (step S48). The area information of the selected instruction item (soft key) is acquired and stored in the storage section (step S49).

Based on the difference between the distances detected this time and the previous time, the enlargement rate of the instruction item (soft key) is updated and the area information of the updated instruction item (soft key) is updated so that the display mode is changed as shown in FIGS. 12C and 12E (step S50). Next, it is determined whether the detected distance "h" to the operation instruction means 15 is equal to or less than a still another prescribed distance "h4" (step S51) When it is determined that the distance "h" exceeds the distance "h4" (No in step S51), the process goes back to step S46 to compare the distance "h" with the distance "h3" again and the following displaying process is performed. On the other hand, when it is determined that the distance "h" is equal to or less than the distance "h4" (Yes in step S51), the area information of the fully enlarged instruction item (soft key) is acquired and stored (step S52). It should be noted that when the distance "h" is equal to or less than the distance "h4", no enlargement process is performed. This is because by maintaining the size of the instruction item (soft key) a user may recognize the instruction item (soft key) more easily to make sure whether the instruction item (soft key) to be selected is correct. When the instruction item (soft key) to be selected is correct, the user may continue to approach the touch sensor on the LCD/touch panel 16 to perform the input operation.

Then, it is determined whether the input operation is carried out by touching the enlarged instruction item (soft key) on the display operations section 14 (step S53). When it is determined that no input operation is detected (No in step S53), the process goes back to step S46 to repeat the process of detecting the distance to the operation instruction means 15. On the other hand, when the input operation is confirmed (Yes in step S53), the code information of the instruction item (soft key) is acquired (step S54), and transmitted to the main control section 17*c* (step S55).

Figure 16:
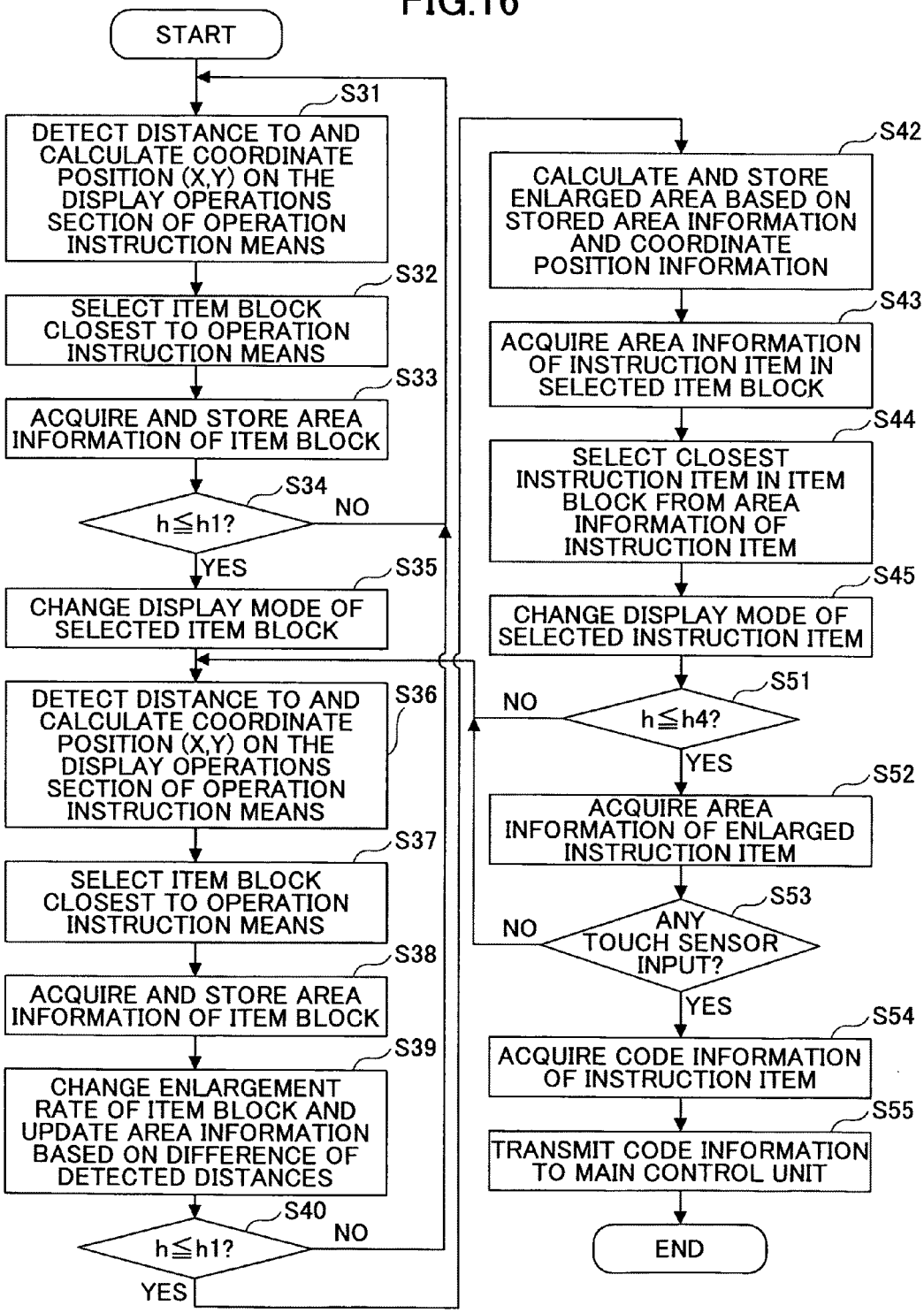
FIG. 16 is a flowchart showing another controlling process of changing the display mode of the display on the display operations section.

FIG. 16 is still another flowchart showing a process of changing a display mode based on the calculation results of the coordinate (position) of and the distance to the operation instruction means 15. The process in FIG. 16 is mostly the same as that in FIG. 14 except in that the enlargement rate changes along the solid line A-B and the dash line B-D in the distance range "h1" and "h4" in FIG. 15 so that the display mode changes as shown in FIG. 13A through 13E.

As shown in FIG. 16, the process in steps S31 through S45 is the same as that in FIG. 14. For example, the distance "h" to the operation instruction means 15 is detected and the display mode of the item block is changed (step S35). Further, the enlargement rate of the item block is changed based on the detected distance to and calculated coordinate position of the operation instruction means 15 (step S39). As shown in FIG. 13A, when the detected distance "h" to the operation instruction means 15 is equal to or less than the distance "h1" (Yes in step S40), the same process in steps S42 through S45 is carried out in a manner so that the display mode of the item block and the display mode of the instruction item (soft key) closest to the operation instruction means 15 are changed as shown in FIGS. 13B and 13D.

Figure 13C:
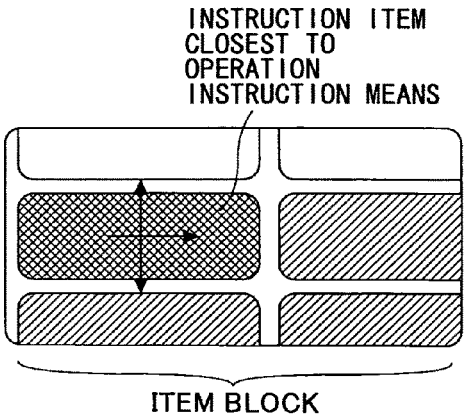
Figure 13E:
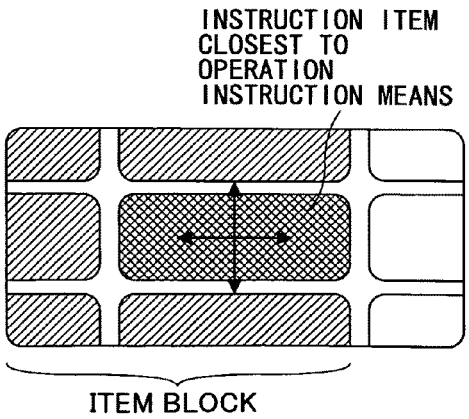

Then, the display mode changes as shown in FIGS. 13C and 13E and it is determined whether the detected distance "h" is equal to or less than the distance "h4" (step S51). In this process, the enlargement rate changes along the line A-D in FIG. 15 when the distance changes from "h1" to "h4". When the detected distance "h" exceeds the distance "h4" (No is step S51), the process goes back to step S36 to repeat the process of changing the display mode of the item block as described above. On the other hand, when the detected distance "h" is equal to or less than the distance "h4" (Yes in step S51), the area information of enlarged instruction item (soft key) is acquired and stored in the storage section (step S52). Then, as described above with reference to FIG. 14, it is determined whether the input operation by touching the enlarged instruction item (soft key) on the display operations section 14 is carried out (step S53). When it is determined that no input operation is detected (No in step S53), the process goes back to step S36. On the other hand, when the input operation is confirmed (Yes in step S53), the code information of the instruction item (soft key) displayed is acquired (step S54), and transmitted to the main control section 17*c* (step S55).

In the above descriptions, as shown in FIG. 15, when and after the distance "h" is equal to or less than the distance "h4", the size of the selected instruction item (soft key) from among plural instruction items (soft keys) is unchanged so that a user may recognize the instruction item (soft key) easily. However, the size of the selected instruction item (soft key) may be enlarged as much as possible on the LCD/touch panel 16 without comparing "h" with the distance "h4", so that a user may recognize the selected instruction item (soft key) easily.

As described above, according to an embodiment of the present invention, it is determined whether each of the display operations section 14 and the second operations section 13 is separated from the operation panel 1, and the position and the distance of the operation instruction means such as a finger is detected. Based on the detection results, the display mode (such as increasing and reducing the sizes, changing positions, changing colors) of the instruction item (soft key) on the LCD/touch panel 16 is changed. By doing this, it becomes possible to improve the operability of the apparatus by changing the display mode depending on the use of the apparatus or each user when plural users use the apparatus.

In an input control device and an image forming apparatus according to an embodiment of the present invention, based on the detection results of the status which of the operation panels is separated from the main body of the apparatus when the apparatus has one or more operation terminals that can be used as the remote terminals and the distance to the operation instruction means such as a finger with respect to the operation panel, the display mode on the display of the operation section is changed, thereby improving the operability of the apparatus corresponding to variable using cases and multi-user environment. Especially, even a user having difficulties in operating a conventional apparatus due to, for example, his/her height, use of a wheelchair, having color vision deficiency or weak vision may easily operate the apparatus according to an embodiment of the present invention. Further, the input control device according to an embodiment of the present invention is advantageous when used as the input device for an apparatus including an image forming apparatus.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

The present application is based on and claims the benefit of priority of Japanese Patent Application Publication Nos. 2007-233835 filed Sep. 10, 2007 and 2007-288525 filed Nov. 6, 2007, the entire contents of which are hereby incorporated herein by reference.

What is claimed is:

1. An input control device for an electronic apparatus, the in control device comprising:

plural selection operation units each inputting the information of an instruction item selected from prescribed instruction items related to the corresponding operations of the electronic apparatus;

a selected information output unit outputting the information of the instruction item input through each of the selection operation units to the electronic apparatus; and a display operation unit which is one of the selection operation units, the display operation unit including:

a display unit for displaying the instruction items, an input unit for inputting the information of the instruction item selected from among the instruction items displayed on the display unit, an instruction position detection unit for detecting the position of operation instruction means for the instruction item displayed on the display operation unit, a display control unit for changing a display mode of the display unit in accordance with the distance between the operation instruction means and the instruction item that is detected by the instruction position detection unit and that is displayed on the display unit, and wherein input control device further comprises a block specifying unit for specifying an item block having plural of the instruction items including the instruction item closest to the operation instruction means, wherein when the position of the operation instruction means detected by the instruction position detection unit is within a prescribed distance, the display control unit changes the display mode of the item block specified by the block specifying unit.

2. The input control device according to claim 1, wherein the block specifying unit specifies the item block including the instruction item including the shortest distance to the operation instruction means and the other instruction items having the similar functions to that of the instruction item having the shortest distance to the operation instruction means.

3. The input control device according to claim 1, wherein after the position of the operation instruction means detected by the instruction position detection unit is within a prescribed distance, the display control unit changes the display mode of the item block in accordance with the distance detected by the instruction position detection unit, the item block including the instruction item having the shortest distance to the operation instruction means and the other instruction items having the similar functions to that of the instruction item having the shortest distance to the operation instruction means.

4. The input control device according to claim 1, wherein when the position of the operation instruction means detected by the instruction position detection unit is within a prescribed distance and the position is not above the display operation unit, the display control unit changes the display mode of the item block including the instruction item having the shortest distance to the operation instruction means and the other instruction items having the similar functions to that of the instruction item having the shortest distance to the operation instruction means.

5. The input control device according to claim 1, wherein after the position of the operation instruction means detected by the instruction position detection unit is within a prescribed distance and when the position of the operation instruction means detected by the instruction position detection unit is within another prescribed distance, the display control unit changes the display mode of the instruction item having the shortest distance to the operation instruction means included in the item block specified by the block specifying unit.

6. The input control device according to claim 1, wherein the method of changing the display mode of the item block and the selected instruction item under the control of the display control unit to distinguish the item block and the instruction item from the other instruction items includes changing colors, changing brightness, using highlighted portions, and using blinking portions.

7. The input control device according, to claim 1, wherein the method of changing the display mode of the item block and the selected instruction item under the control of the display control to distinguishing the item block and the instruction item from the other instruction items is enlarging an image.

8. An input control device for an electronic apparatus, the input control device comprising:

plural selection operation units each inputting the information of an instruction item selected from prescribed instruction items related to the corresponding operations of the electronic apparatus;

a selected information output unit outputting the information of the instruction item input through each of the selection operation units to the electronic apparatus; and a display operation unit which is one of the selection operation units, the display operation unit including:

a display unit for displaying the instruction items, an input unit for inputting the information of the instruction item selected from among the instruction items displayed on the display unit, an instruction position detection unit for detecting the position of operation instruction means for selecting the instruction item displayed on the display operation unit, and a display control unit for changing a display mode of the display unit in accordance with the distance between the operation instruction means and the instruction item that is detected by the instruction position detection unit and that is displayed on the display unit.

9. The input control device according to claim 8, wherein when any of the selection operation units each removably mounted on the input control device is separated from the input control device, the display control unit changes the display mode of the instruction items of the selection operation units in accordance with which of the selection operation units is separated from the input control device.

10. The input control device according to claim 9, wherein the display control unit divides the display of the display unit in accordance with which of the selection operation units is separated, and when the display control unit changes the display mode of the area for one of the selection operation units, the display control unit does not change the display mode of the areas of the other selection operation units.

11. The input control device according to claim 8, wherein the display control unit is capable of selecting the display modes including the determination whether the display control unit changes the display mode in accordance with which of the selection operation units is separated from the input control device.

12. An image forming apparatus comprising: an input control device according to claim 1, wherein a process of forming an image is performed in accordance with the information of the instruction item output from the input control device.

* * * * *